US009939788B2

(12) United States Patent
Ko et al.

(10) Patent No.: US 9,939,788 B2
(45) Date of Patent: Apr. 10, 2018

(54) SMART WATCH AND METHOD FOR CONTROLLING THE SAME

(71) Applicant: LG ELECTRONICS INC., Seoul (KR)

(72) Inventors: Dongseuck Ko, Seoul (KR); Hyeokjin Kwon, Seoul (KR); Jinyung Park, Seoul (KR); Junhee Han, Seoul (KR); Jonghun Kwon, Seoul (KR); Jongcheol Kim, Seoul (KR); Hanna Lee, Seoul (KR); Pilgoo Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/096,131

(22) Filed: Apr. 11, 2016

(65) Prior Publication Data

US 2016/0306328 A1 Oct. 20, 2016

Related U.S. Application Data

(60) Provisional application No. 62/148,745, filed on Apr. 17, 2015.

(30) Foreign Application Priority Data

Jul. 14, 2015 (KR) ..... 10-2015-0099796
Jul. 14, 2015 (KR) ..... 10-2015-0099797

(51) Int. Cl.
*G04C 17/00* (2006.01)
*G04G 21/08* (2010.01)
(Continued)

(52) U.S. Cl.
CPC ..... *G04G 21/08* (2013.01); *G04C 3/001* (2013.01); *G04C 17/00* (2013.01); *G04C 17/0091* (2013.01); *G04G 21/04* (2013.01)

(58) Field of Classification Search
CPC ..... G04B 19/04; G04C 17/009; G04G 9/00; G04G 9/04; G04G 9/08; G04G 9/0082; G04G 21/08
See application file for complete search history.

(56) References Cited

U.S. PATENT DOCUMENTS 4,413,915 A * 11/1983 Besson ..... G04G 9/0082 349/113
4,488,818 A * 12/1984 Saurer ..... G04G 9/0094 368/242
(Continued)

FOREIGN PATENT DOCUMENTS

CN 2357351 1/2000
CN 1428671 7/2003
(Continued)

OTHER PUBLICATIONS

European Patent Office Application Serial No. 16164425.7, Search Report dated Sep. 19, 2016, 9 pages.
(Continued)

*Primary Examiner* — Vit W Miska
(74) *Attorney, Agent, or Firm* — Lee, Hong, Degerman, Kang & Waimey

(57) ABSTRACT

A smart watch and method for controlling the same are disclosed, by which both a physical watch function and a mobile terminal function are provided. The present application includes a case, at least one physical hand situated in the case, the at least one physical hand configured to display a current time, a display unit situated below the hand in the case, the display unit configured to display various informations, and a movement configured to rotate the hand, the movement connected to the hand through the display unit in the case.

17 Claims, 13 Drawing Sheets

(51) Int. Cl.
*G04C 3/00* (2006.01)
*G04G 21/04* (2013.01)

(56) References Cited

U.S. PATENT DOCUMENTS 4,629,329 A * 12/1986 Komiyama ..... G04B 37/084 368/10
5,089,998 A * 2/1992 Rund ..... G04G 13/02 368/230
5,528,559 A 6/1996 Lucas
5,740,130 A * 4/1998 Grupp ..... G02F 1/133553 349/113
6,084,828 A 7/2000 Bland et al.
6,661,743 B1 * 12/2003 Mafune ..... G04G 9/126 368/239
6,937,301 B2 * 8/2005 Sekiguchi ..... G02F 1/13471 349/114
6,967,903 B2 * 11/2005 Guanter ..... G04G 11/00 368/224
7,420,881 B2 * 9/2008 Frenkel ..... G06F 1/3228 345/169
2002/0048221 A1 * 4/2002 Basturk ..... G02F 1/133533 368/84
2002/0060953 A1 * 5/2002 Farine ..... G04C 3/14 368/69
2003/0123328 A1 7/2003 Guanter
2004/0013042 A1 1/2004 Farine
2004/0145971 A1 7/2004 Lau
2006/0120222 A1 * 6/2006 Mazzetti ..... G04B 19/30 368/223
2007/0109918 A1 * 5/2007 Furetta ..... G02F 1/1335 368/294
2007/0274161 A1 * 11/2007 Rydgren ..... G04C 17/0091 368/80
2008/0151700 A1 6/2008 Inoue et al.
2015/0078144 A1 * 3/2015 Gong ..... G04C 17/0041 368/228
2015/0301506 A1 * 10/2015 Koumaiha ..... G04G 21/08 368/10

FOREIGN PATENT DOCUMENTS

CN 1489012 4/2004
CN 101206455 6/2008
CN 101449216 6/2009
CN 102354268 2/2012
CN 203465525 3/2014
CN 103823354 5/2014
EP 3051407 8/2016

OTHER PUBLICATIONS

European Patent Application No. 16164425.7, Search Report dated Feb. 8, 2017, 18 pages.
The State Intellectual Property Office of the People's Republic of China Application Serial No. 201610236648.8, Office Action dated Jan. 30, 2018, 14 pages.

* cited by examiner (a) (b)

(a) (b)

(a) (b)

SMART WATCH AND METHOD FOR CONTROLLING THE SAME

Pursuant to 35 U.S.C. § 119, this application claims the benefit of earlier filing date and right of priority to Korean Patent Application Nos. 10-2015-0099796, filed on Jul. 14, 2015, 10-2015-0099797, filed on Jul. 14, 2015, and also claims the benefit of U.S. Provisional Application No. 62/148,745, filed on Apr. 17, 2015, the contents of which are all incorporated by reference herein in their entirety.

BACKGROUND OF THE INVENTION

Field of the Invention

The present invention relates to a smart device, and more particularly, to a smart watch wearable on user's wrist and method for controlling the same.

Discussion of the Related Art

Terminals may be generally classified as mobile/portable terminals or stationary terminals according to their mobility. Mobile terminals may also be classified as handheld terminals or vehicle mounted terminals according to whether or not a user can directly carry the terminal.

Mobile terminals have become increasingly more functional. Examples of such functions include data and voice communications, capturing images and video via a camera, recording audio, playing music files via a speaker system, and displaying images and video on a display. Some terminals include additional functionality which supports electronic game playing, while other terminals are configured as multimedia players. More recently, mobile terminals have been configured to receive broadcast and multicast signals which permit viewing of contents such as videos and television programs. In order to run such functions, a mobile terminal is basically connected to other devices or network using various communication protocols and can provide a user with ubiquitous computing. In particular, a mobile terminal has been evolved into a smart device that enables the connectivity to networks and the ubiquitous computing.

Thus, a smart device as a mobile terminal has been manufactured in a traditional size for a user to hold the smart device with a hand, whereby the user carries the smart device in a manner of holding the smart device with his hand or putting the smart device in a bag or pocket. Recently, owing to the technological developments, a smart device tends to be manufactured in further smaller size and is developed into a wearable smart device directly worn on user's body. Particularly, among the above-configured wearable smart devices, a smart watch configured in form of a watch to be worn user's wrist has been developed and used popularly.

The smart watch has been developed in wearable small size to be equipped with a variety of improved functions of a mobile terminal as well as with the general watch functions (e.g., a time information providing function, etc.). Moreover, a recently developed smart watch can provide a multimedia function as well as a communication function and a personal information management function. Yet, as most of devices are digitalized, users tend to put more values on analog devices. Hence, users prefer general analog watches despite various and convenient functions of a smart watch. In particular, users tend to prefer real hands (i.e., physical hour and minute hands) to virtual hands electronically displayed on a display unit. For this reason, in order to meet user's recent needs, it is necessary for a smart watch to provide various function of a smart device using a display unit, as mentioned in the foregoing description, while display a time using physical hands. Moreover, an optimal control method needs to be provided in order to use both of the physical hands and a screen of the display unit more efficiently.

SUMMARY OF THE INVENTION

Accordingly, embodiments of the present application are directed to a smart watch and method for controlling the same that substantially obviate one or more problems due to limitations and disadvantages of the related art.

One object of the present application is to provide a smart watch, by which both an analog watch and a smart device can be provided to a user effectively.

Another object of the present application is to provide a method of controlling a smart watch, by which functions of an analog watch and functions of a smart device can be effectively provided to a user.

Additional advantages, objects, and features of the invention will be set forth in the disclosure herein as well as the accompanying drawings. Such aspects may also be appreciated by those skilled in the art based on the disclosure herein.

To achieve these objects and other advantages and in accordance with the purpose of the invention, as embodied and broadly described herein, a smart watch according to one embodiment of the present application may include a case, at least one physical hand situated in the case, the at least one physical hand configured to display a current time, a display unit situated below the hand in the case, the display unit configured to display various informations, and a movement configured to rotate the hand, the movement connected to the hand through the display unit in the case.

Preferably, the hand may include a single hand pointing at hour and minute simultaneously or hour and minute hands configured to point at the hour and the minute, respectively. The movement may be configured to be electronically controlled. The movement may be configured to use a power source separate from that of the display unit. The smart watch may further include a $1^{st}$ battery configured to supply a $1^{st}$ power to the display unit and related parts and a $2^{nd}$ battery configured to supply a $2^{nd}$ power to the movement.

Preferably, the smart watch may further include a crown operably connected to the movement, and the crown may be configured to mechanically control the hand. The crown may be configured to electronically control the display unit.

Preferably, the display unit may be inserted between the hand and the movement. The hand may be disposed above the display unit and the movement may be disposed below the display unit. The display unit may include a perforated hole configured to enable a connecting part of the movement and the hand to pass through. The movement may be configured to rotate the hand and wherein the movement comprises a shaft penetrating the display unit to connect to the hand. The display unit may be configured to entirely close an opening formed in the case and information may be displayed on a whole surface of the display unit exposed to a user through the opening.

Preferably, the smart watch may further include a window installed in the case to be disposed above the hand and the window may include a touch sensor. The touch sensor may be configured to electronically control the hand in response to a touch input applied to the touch sensor.

Preferably, the display unit may be operated according to a $1^{st}$ display setting used during a $1^{st}$ mode for the smart watch to provide an analog watch function or a $2^{nd}$ display setting used during a $2^{nd}$ mode for the smart watch to provide functions different from the analog watch function and the $2^{nd}$ display setting may be different from the $1^{st}$ display setting. The $1^{st}$ display setting may include a watch face including an index indicated by the physical hand to display a time and the $2^{nd}$ display setting may include a screen configured for the provided functions.

Preferably, the display unit may be operated according to a $1^{st}$ hand setting used during a $1^{st}$ mode for the smart watch to provide an analog watch function or a $2^{nd}$ hand setting used during a $2^{nd}$ mode for the smart watch to provide functions different from the analog watch function and the $2^{nd}$ display setting may be different from the $1^{st}$ display setting. The $1^{st}$ hand setting and the $2^{nd}$ hand setting may include different dispositions of hands or different transparencies of the hands, respectively. The $1^{st}$ hand setting may dispose the hand to point at an index corresponding to a current time displayed on the display unit and the $2^{nd}$ hand setting may adjust the hand to maximize a screen of the display unit during the $2^{nd}$ mode. The $2^{nd}$ hand setting may align the hands in a line or enable the hands to become transparent.

In another aspect of the present application, as embodied and broadly described herein, in a smart watch comprising a case, at least one physical hand situated in the case, the at least one physical hand configured to display a current time, and a display unit situated below the hand in the case, the display unit configured to display various informations, a method of controlling a smart watch according to another embodiment of the present application may include the steps of performing a $1^{st}$ mode for the smart watch to provide an analog watch function using the physical hand, searching for an event requesting a function other than the analog watch function in the course of performing the $1^{st}$ mode, and if the event occurs, performing a 2nd mode for the smart watch to perform functions different from the analog watch function, wherein the $1^{st}$ and $2^{nd}$ mode include $1^{st}$ and $2^{nd}$ display settings configured differently to control the display unit and $1^{st}$ and $2^{nd}$ hand settings configured differently to control the hand, respectively.

Preferably, the searching step may include the step of searching for one of the event for a user to switch the smart watch to the $2^{nd}$ mode manually and the event of switching the smart watch to the $2^{nd}$ mode automatically. The automatically switching event may include at least one of a notification, an alert and an incoming call delivered externally. The manually switching event may include one of a user's gesture and a manipulation of the smart watch.

The $1^{st}$ and $2^{nd}$ display settings may include different scenes and contents, respectively. The $1^{st}$ display setting may include a watch face including an index indicated by the physical hand to display a time and the $2^{nd}$ display setting may include a scene configured for a provided function.

Preferably, the $1^{st}$ display setting may dispose a different item and/or different interfaces in a screen of the display unit to avoid interfering with the physical hand and the $1^{st}$ display setting may adjust a color of the screen of the display unit to emphasize the physical hand. The $1^{st}$ display setting may provide a scene configured to provide additional functions related to a watch function. The $2^{nd}$ display setting may provide a scene configured for a function related to the event found in the searching step directly or indirectly.

Preferably, the $1^{st}$ and $2^{nd}$ hand settings may include different dispositions of hands or different transparencies of the hands, respectively. The $1^{st}$ hand setting may dispose the hand to point at an index corresponding to the current time displayed on the display unit and the $2^{nd}$ hand setting may adjust the hand to avoid interfering with a screen of the display unit. The $2^{nd}$ hand setting may align the hands in a line during the $2^{nd}$ mode or enable the hands to become transparent during the $2^{nd}$ mode.

Preferably, the $2^{nd}$ mode may include a $3^{rd}$ hand setting for using the hand to provide a function different from the watch function. The $3^{rd}$ hand setting may use the hand as one of an indicator indicating a prescribe information and a selector selecting an object displayed on the display unit.

Preferably, the display unit and the hand may be controlled by a crown rotatably provided to the case in each of the $1^{st}$ mode and the $2^{nd}$ mode. The crown may be used to adjust the hand to display an accurate time in the $1^{st}$ mode and the crown may be used to change a background provided by the display unit in the $1^{st}$ mode. The crown may be used to change a setting of a specific function using a scene provided by the display unit in the $2^{nd}$ mode and the crown may be used to scroll a prescribed list provided by the display unit in the $2^{nd}$ mode.

Preferably, the hand may be controlled by a touch sensor included in a window installed in the case in each of the $1^{st}$ mode and the $2^{nd}$ mode. The hand may be rotated by swiping the window. Before the hand is rotated by swiping the window, the hand may be selected to be rotated by touching the window above the hand.

Effects obtainable from the present invention may be non-limited by the above mentioned effect. And, other unmentioned effects can be clearly understood from the following description by those having ordinary skill in the technical field to which the present invention pertains. It is to be understood that both the foregoing general description and the following detailed description of the present invention are exemplary and explanatory and are intended to provide further explanation of the invention as claimed.

BRIEF DESCRIPTION OF THE DRAWINGS

The present application will become more fully understood from the detailed description given herein below and the accompanying drawings, which are given by illustration only, and thus are not limitative of the present application, and wherein.

DETAILED DESCRIPTION OF THE INVENTION

Figure 1:
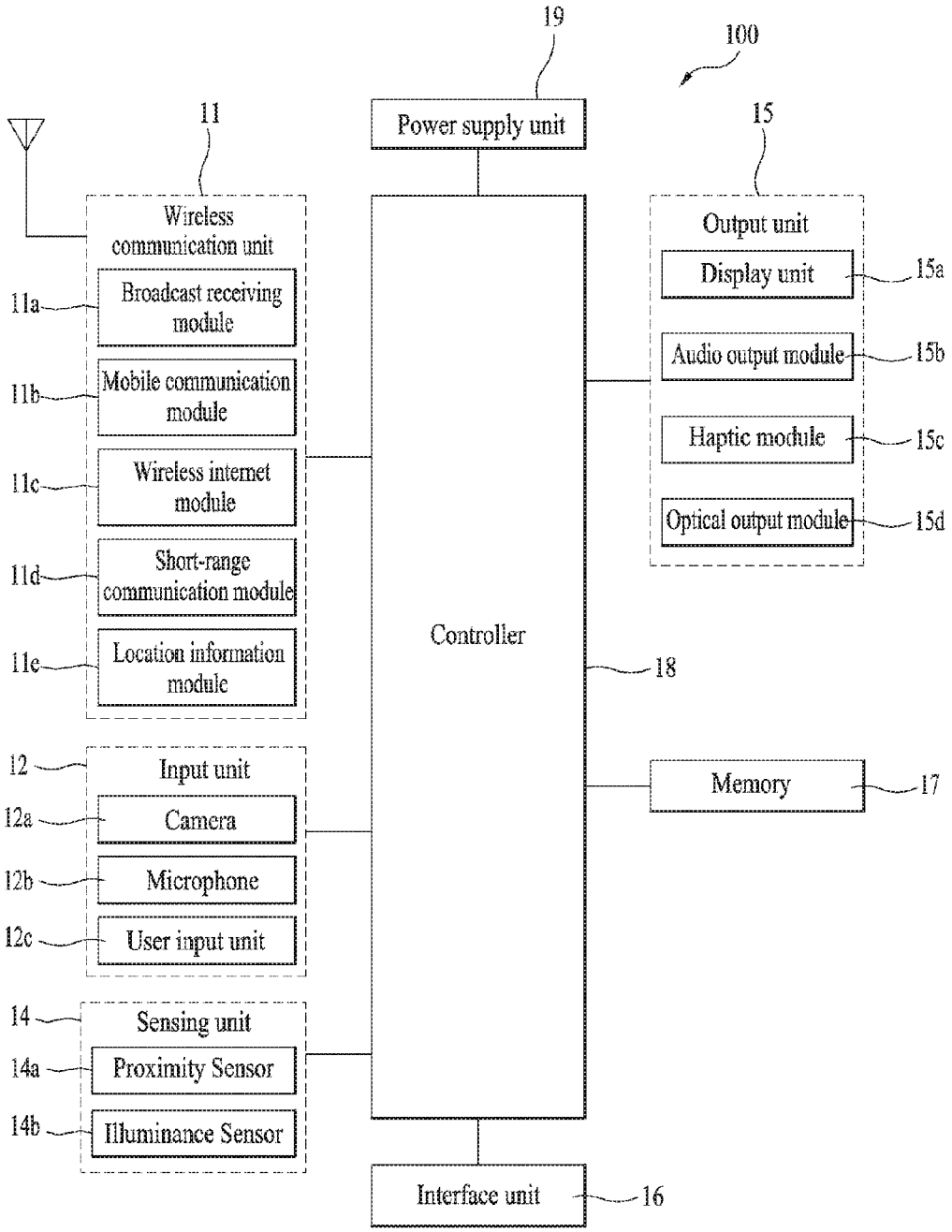
FIG. 1 is a block diagram to illustrate a configuration of a smart watch described in the present application.

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a term such as "module" and "unit" may be used to refer to elements or components. Use of such a term herein is merely intended to facilitate description of the specification, and the term itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first ($1^{st}$), second ($2^{nd}$), etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "comprise", "include" or "have" are used herein and should be understood that they are intended to indicate an existence of several components, functions or steps, disclosed in the specification, and it is also understood that greater or fewer components, functions, or steps may likewise be utilized. Moreover, due to the same reasons, it is also understood that the present application includes a combination of features, numerals, steps, operations, components, parts and the like partially omitted from the related or involved features, numerals, steps, operations, components and parts described using the aforementioned terms unless deviating from the intentions of the disclosed original invention.

Smart devices presented herein may be implemented using a variety of different types of terminals. Examples of such terminals include cellular phones, smart phones, laptop computers, digital broadcast terminals, personal digital assistants (PDAs), portable multimedia players (PMPs), navigators, slate PCs, tablet PCs, ultrabooks, wearable devices (for example, smart watches, smart glasses, head mounted displays (HMDs)), and the like.

By way of non-limiting example only, further description will be made with reference to particular types of smart devices. However, such teachings apply equally to other types of smart devices, such as those types noted above.

FIG. 1 is a block diagram to describe a smart watch related to the present application. A general configuration of the smart watch is described with reference to FIG. 1 as follows.

First of all, the smart watch 100 may include components such as a wireless communication unit 11, an input unit 12, a sensing unit 14, an output unit 15, an interface unit 16, a memory 17, a controller 18, a power supply unit 19, and the like. It is appreciated that implementing all of the components shown in FIG. 1 is not a requirement, and that greater or fewer components may alternatively be implemented. Moreover, the real shapes and structures of the aforementioned components are not illustrated all but the shapes and structures of some significant components are shown in the drawings following FIG. 1. Yet, it is apparent to those skilled in the art that components described without being illustrated can be included in the smart watch to embody the functions of a smart device.

In particular, among the above-listed components, the wireless communication unit 11 typically includes one or more modules which permit communications such as wireless communications between the smart watch 100 and a wireless communication system, communications between the smart watch 100 and another smart watch, communications between the smart watch 100 and an external server. Further, the wireless communication unit 11 typically includes one or more modules which connect the smart watch 100 to one or more networks.

To facilitate such communications, the wireless communication unit 11 may include one or more of a broadcast receiving module 11*a*, a mobile communication module 11*b*, a wireless Internet module 11*c*, a short-range communication module 11*d*, and a location information module 11*e*.

The input unit 12 includes a camera 12*a* (or an image input unit) for an image or video signal input, a microphone 12*b* (or an audio input unit) for an audio signal input, and a user input unit 12*c* (e.g., a touch key, a push key, etc.) for receiving an input of information from a user. Audio or image data collected by the input unit 12*c* may be analyzed and processed into user's control command.

The sensing unit 14 is typically implemented using one or more sensors configured to sense internal information of the smart watch, the surrounding environment of the smart watch, user information, and the like. For example, the sensing unit 14 may include a proximity sensor 14*a* and an illumination sensor 14*b*. If desired, the sensing unit 14 may alternatively or additionally include other types of sensors or devices, such as a touch sensor, an acceleration sensor, a magnetic sensor, a gravity sensor (G-sensor), a gyroscope sensor, a motion sensor, an RGB sensor, an infrared (IR) sensor, a finger scan sensor, a ultrasonic sensor, an optical sensor (for example, the camera 12*a*), the microphone 12*b*, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few. The smart watch 100 disclosed in the present specification may be configured to utilize information obtained from the sensing unit 14, and in particular, information obtained from one or more sensors of the sensing unit 140, and combinations thereof.

The output unit 15 is typically configured to output various types of information, such as audio, video, tactile output, and the like. The output unit 15 may include a display unit 15*a*, an audio output unit 15*b*, a haptic module 15*c*, and an optical output module 15*d*. The display unit 15*a* may have an inter-layered structure or an integrated structure with a touch sensor in order to facilitate a touchscreen. The touchscreen may provide an output interface between the smart watch 100 and a user, as well as function as the user input unit 12*c* which provides an input interface between the smart watch 100 and the user.

The interface unit 16 serves as an interface with various types of external devices that can be coupled to the smart watch 100. The interface unit 16, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the smart watch 100 may perform assorted control functions associated with a connected external device, in response to the external device being connected to the interface unit 16.

The memory 17 is typically implemented to store data to support various functions or features of the smart watch 100. For instance, the memory 170 may be configured to store application programs (or applications) run in the smart watch 100, data or instructions for operations of the smart watch 100, and the like. Some of these application programs may be downloaded from an external server via wireless communication. Other application programs may be installed on the smart watch 100 at time of manufacturing or shipping, which is typically the case for basic functions of the smart watch 100 (for example, receiving a call, placing a call, receiving a message, sending a message, and the like). It is common for application programs to be stored in the memory 17, installed on the smart watch 100, and launched by the controller 18 to perform operations (or functions) for the smart watch 100.

The controller 18 typically functions to control overall operations of the smart watch 100, in addition to the operations associated with the application programs. The controller 18 may provide or process information or functions appropriate for a user by processing signals, data, information and the like, which are inputted or outputted by the various components depicted in the above description, or running application programs stored in the memory 17.

Moreover, in order to launch an application program stored in the memory 17, the controller 18 can control at least one portion of the components described with reference to FIG. 1. Furthermore, the controller 18 controls at least two of the components included in the smart watch 100 to be activated in combination to launch the application program.

The power supply unit 19 can be configured to receive external power or provide internal power in order to supply appropriate power required for operating elements and components included in the smart watch 100. The power supply unit 19 may include a battery 19*a*. In particular, the battery 19*a* may include at least one of a built-in battery or a replaceable (or detachable) battery.

At least some of the components can operate cooperatively to implement the operations, controls or controlling methods of the smart watch 100 according to various embodiments mentioned in the following description. And, the operation, control or controlling method of the smart watch 100 may be implemented on the smart watch 100 by launching at least one application program saved in the memory 17.

In the following drawings, the smart watch 100 is illustrated as having a type wearable on user's wrist, i.e., a traditional watch type, by which the present application is non-limited. Thus, the smart watch 100 may alternatively be embodied to have any of a variety of different configurations. For instance, the smart watch 100 may have a necklace shape. Discussion herein will often relate to a particular type of the smart watch 100. However, such teachings with regard to a particular type of the smart watch 100 will generally apply to other types of smart watches as well.

Figure 2:
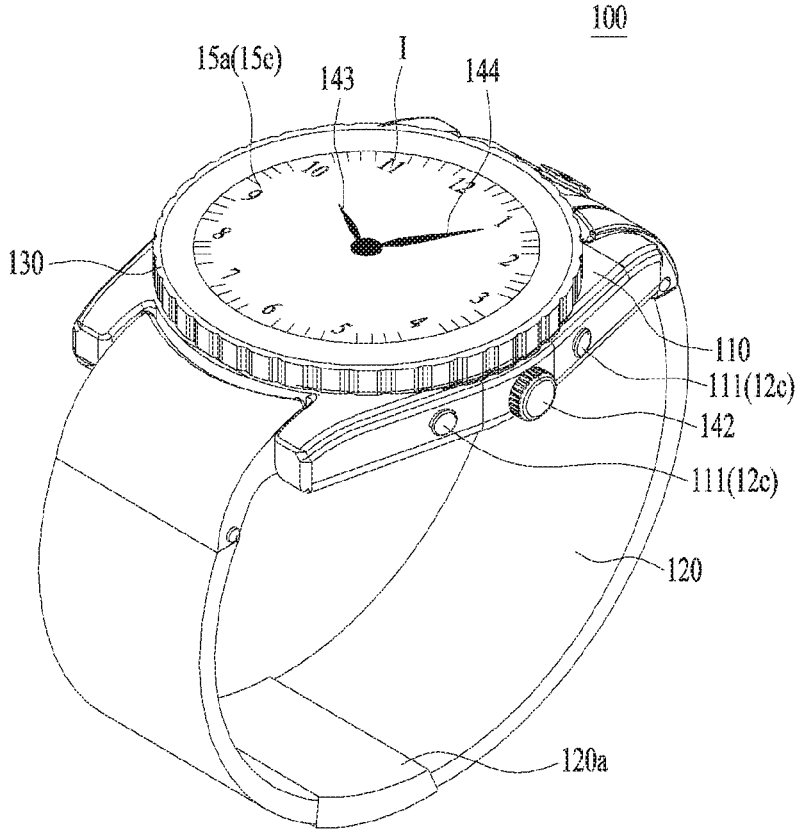
FIG. 2 is a perspective diagram of a smart device according to one example of the present application.
Figure 3:
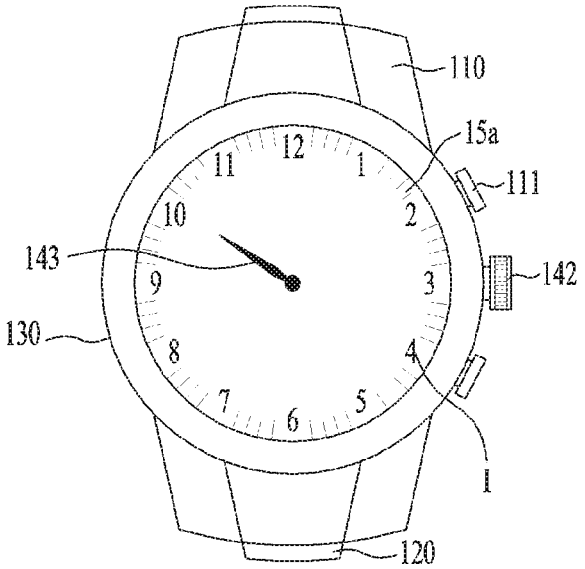
FIG. 3 is a front diagram for one example of a single physical hand in a smart watch.
Figure 4:
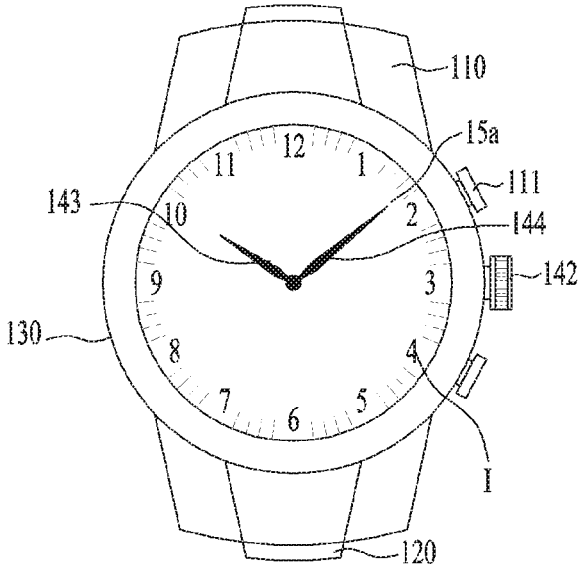
FIG. 4 is a front diagram for one example of a plurality of physical hands in a smart watch.
Figure 5:
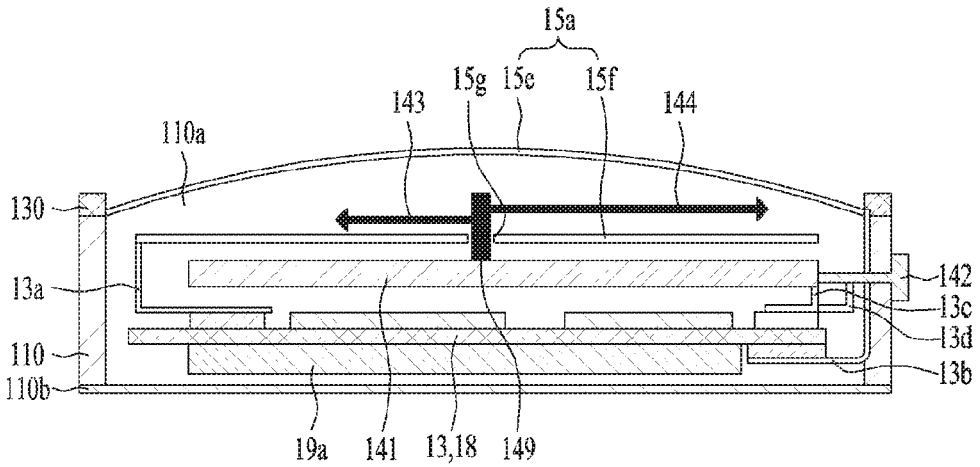
FIG. 5 and FIG. 6 are cross-sectional diagrams of a smart watch.
Figure 6:
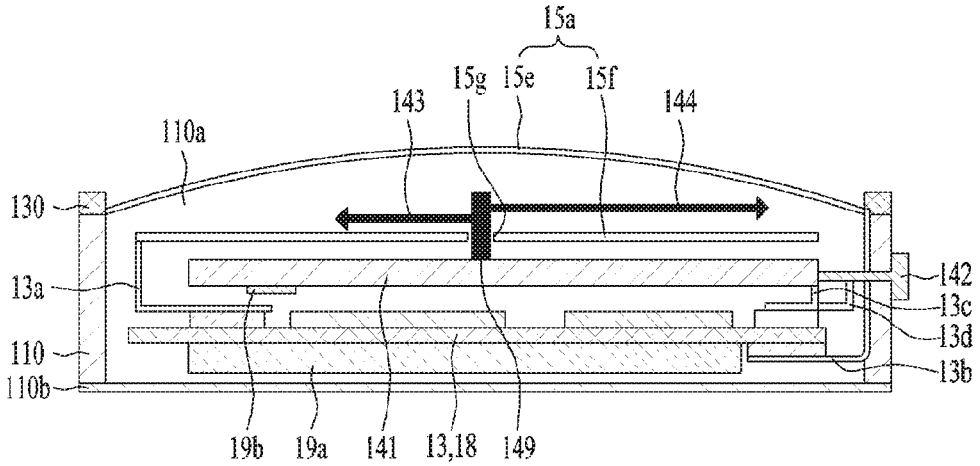

In continuation with the general configuration of the above-described smart watch 100, the structure of the smart watch 100 is described with reference to the accompanying drawings. Regarding this, FIG. 2 is a perspective diagram of a smart device according to one example of the present application. FIG. 3 is a front diagram for one example of a single physical hand in a smart watch. FIG. 4 is a front diagram for one example of a plurality of physical hands in a smart watch. FIG. 5 and FIG. 6 are cross-sectional diagrams of a smart watch. Since FIG. 2 shows the overall structure of the smart watch 100 well, all the descriptions shall refer to FIG. 2 basically unless a specific drawing to be referred to is mentioned.

The smart watch 100 may substantially include a case 110 configured to form a body of the smart watch 100. The case 110, as shown well in FIG. 5 and FIG. 6, can form an inner space in a prescribed size to accommodate various parts therein. The case 110 may also have an opening 110*a* configured to communicate with the inner space to enable the parts to be installed in the inner space. The case 110 may be configured with a single member overall. Yet, the case 110 may have a case back 110*b* detachably attached thereto, as shown in the drawing, and the accommodated internal parts can be easily accessed through the detachable or separable case back 110*b*. Moreover, the case 110 shown in the drawing has a circular shape in general. Alternatively, the case 110 may have one of various other shapes such as a rectangle and the like.

The smart watch 100 may include a band 120 connected to the case 110 as well. The band 120 may be configured to enable a body, i.e., the smart watch 100 to be worn on a wrist. The band 120 is configured to be wrapped round a wrist by being worn on the wrist and may be formed of a flexible material to be worn on the wrist easily and conveniently. For such an example, the band 120 may be formed of material such as leather, rubber, silicon, synthetic resin, or the like. The band 120 is configured to be detachable from the case 110 so as to be replaced by one of various types of bands in accordance with user's taste. Meanwhile, the band 120 may be used in expanding performance of an antenna of the wireless communication unit 11 shown in FIG. 1. For instance, a ground extension part (not shown in the drawing) configured to extend a ground region by being electrically connected to the antenna may be built in the band 120. And, a fastener 120*a* may be provided to the band. The fastener 120*a* may be embodied using at least one of a buckle, a snap-fit capable hook structure, Velcro™, and the like, and may include a flexible or stretchable section or material. According to the example shown in FIG. 2, the fastener 120*a* is embodied into a buckle type.

The smart watch 100 may include a bezel 130 situated on the case 110. The bezel 130 is formed of a member in a ring shape and may extend along an edge of the case 110. In particular, the bezel 130 may be configured to enclose the opening 110*a* of the case 110. Hence, as mentioned in the following description, the bezel 130 encloses the display unit 15*a* disposed in the opening 110*a* so as to protect the display unit 15*a*. Moreover, the bezel 130 may hold a separate glass or crystal member configured to protect the display unit 15*a* as well. A window 15*e* of the display unit 15*a*, which will be described later, may correspond to the glass or crystal member. Besides, the bezel 130 may be configured to provide other functions and used for the purpose of decoration in addition to the protective purposes.

As mentioned in the foregoing description, in aspect of functionality, the case 110 may be basically configured to support various electronic and mechanical parts required for operations of the smart watch 100. As FIG. 5 and FIG. 6 show the internal configuration of the smart watch, internal parts of the smart watch are described in detail with reference to the corresponding drawings as follows.

First of all, the smart watch 100 can include the display unit 15*a* as the output unit 15. The display unit 15*a* may be exposed from the smart watch 100 in a manner of providing a fine view to a user currently wearing the smart watch 100. The display unit 15*a* is basically disposed in the case 110 and may be exposed to a user through the opening 110*a* of the case 110. Moreover, the display unit 15*a* can provide a user with various kinds of informations according to function of a mobile terminal or a smart device. In particular, the display unit 15*a* can display information processed by the smart watch 100. For instance, the display unit 15*a* basically outputs various images and text informations and is also able to display a running screen information of an application run in the smart watch 100 or a UI (user interface) or a GUI (graphic user interface) according to the running screen information. Moreover, the display unit 15*a* can inform a user of a current time. In order to display the current time, the display unit 15*a* can directly display numerals corresponding to the current time or may display a dial or face and hands like an analog watch. In particular, the display unit 15*a* and other electronic parts related to the display unit 15*a* can implement an electronic and virtual watch through the smart watch 100.

The display unit 15*a* may be implemented using one or more suitable display devices. Examples of such suitable display devices include a liquid crystal display (LCD), a thin film transistor-liquid crystal display (TFT-LCD), an organic light emitting diode (OLED), a flexible display, a 3-dimensional (3D) display, an e-ink display, and combinations thereof. The display unit 15*a* may include a display module 15*f* and a window 15*e* configured to cover the display module 15*f*. The display module 15*f* may include the aforementioned display device such as LCD, OLED, or the like and is the component that actually displays image information. The window 15*e* may be disposed on a part of the display module 15*f* exposed to a user and is able to protect the display module 15*f* externally. In addition to the protective functions, the window 15*e* should be configured to allow the information, which is displayed on the display module 15*f*, to be viewed by a user. Therefore, the window 15*e* may be formed of material having proper strength and transparency. In particular, the window 15*e* can function as a glass or crystal member of a normal watch. Referring to FIG. 5 and FIG. 6, the window 15*e* may be separated or detached from the display module 15*f* In this case, as shown in the drawings, the bezel 130 may be configured to hold the window 15*e*.

In order to receive a control command by a touch mechanism, the display unit 15*a* may include a touch sensor configured to sense a touch to the display unit 15*a*. Using this, if a touch is applied to the display unit 15*a*, the touch sensor senses the corresponding touch and is then able to generate a control command corresponding to the touch based on the sensed touch. Contents inputted by the touch mechanism may include texts, numerals, menu items indicated or designated in various modes, and the like. The touch sensor may be configured in a form of a film having a touch pattern, disposed between the window 15*e* and the display module 15*f*, or include a metal wire which is patterned directly on a backside of the window 15*e*. In case that the window 15*e* is detachable from the display module 15*f*, as shown in FIG. 5 and FIG. 6, the touch sensor may be integrally formed with the window 15*e*. Thus, the display unit 15*a* may also form a touchscreen together with the touch sensor. In this case, the touchscreen may serve as the user input unit 12*c* (see FIG. 1). If necessary, a physical key (e.g., a push key) may be additionally provided as the user input unit 12*c* adjacent to the display unit 15*a* corresponding to the touchscreen to facilitate user's inputs. Looking into the smart watch 100 shown in FIG. 5 and FIG. 6, the window 15*e* is disposed in a manner of being spaced apart from the display module 15*f* and plays a role in protecting internal parts of the smart watch 100 like the glass or crystal of a normal watch. On the other hand, the display module 15*f* still plays a unique role or function of the display unit 15*a* in displaying information. Thus, in case that the window 15*e* and the display module 15*f* performs functions separated and distinguished from each other, the window 15*e* may be regarded as a part separated from the display unit 15*a* structurally and functionally. Hence, in the following description, it may be appreciated that the display unit 15*a* substantially means the display module 15*f* only.

A circuit board 13 is the component on which various electronic parts, and more particularly, processors configuring a control unit 18 are mounted together with other circuits and devices supporting them and may be installed in the case 110. Besides, the respective components 11 to 19 shown in FIG. 1 may be directly installed on the circuit board 13 to be controlled by the control unit 18 or may be electrically connected to the circuit board 13 by being installed in the case 110. For instance, as shown in FIG. 5 and FIG. 6, the window 15*e* (i.e., touch sensor) and the display module 15*f* can be connected to the circuit board 13 through wirings 13*b* and 13*a*, respectively. In particular, the control unit 18 can receive a command by a touch from the touch sensor of the window 15*e* via the wiring 13*a* and is able to control various parts including the display module 15*f* based on the received command. Hence, the control unit 18 can be called one of various names such as a controller, a controlling device and the like and is able to control the smart watch 100 and all the components of the smart watch 100. Such controllable components include not only the components shown in FIG. 1 but also other components mentioned in the following description. This is why the control unit 18 can become a substantial component for appropriately performing a controlling method according to the present application by controlling operations of other components.

Moreover, the smart watch 100 may further include a battery 19*a* (cf. FIG. 1) as a power supply unit 19 configured to supply power. The battery 19*a* may be installed in the case 110 stationarily or detachably. And, the battery 19*a* can be charged via a power cable connected to the smart watch 100. Moreover, the battery 19*a* may be configured to enable the wireless charging through a wireless charging device. In this case, the wireless charging may be embodied by magnetic induction or resonance (e.g., magnetic resonance).

In addition to the digital device (e.g., mobile terminal, smart device, etc.) provided by the various electronic parts mentioned in the foregoing description, the smart watch 100 may further include a watch as an analog device. In particular, the smart watch 100 may be configured to actually display a current time using physical hand(s). And, such a time display may be performed by a physical watch unit 140.

The smart watch 100 may include a movement 141 as the physical watch unit 140. The movement 141 can be located in the case 110, which is shown well in FIG. 5 and FIG. 6. The movement 141 may be configured to move physical hands 143 and 144, which are described in the following, to display a current time. In particular, the movement 141 includes a multitude of small parts such as gears, springs and the like to move the hands 143 and 144 connected to the movement 141. And, these parts are accommodated in a separate housing. In more particular, the movement 141 can be installed as a module in the case 110.

The smart watch 100 may include at least one hand 143 as the physical watch unit 140. The hand 143 and 144 may include a physical member, and more particularly, a member in a needle shape. Like the normal analog watch, the hand 143 and 144 is disposed at the center of the case 110. As mentioned in the foregoing description, an inner circumference of the case 110 forms the opening 110*a* of the case 110. The display unit 15*a*, and more particularly, the display module 15*f* is inserted in the case 110 through the opening 110*a* and may have a size approximately corresponding to a size of the opening 110*a*. Hence, the hand 143 is disposed at the center of the case 110 and can be also disposed at the center of the display unit 15*a*, and more particularly, at the center of the display module 15*f*. On the other hand, if necessary, the hand 143 can be disposed at a different location other than the center of the case 110 or the display unit 15*a*. Moreover, like the normal analog watch, the hand 143 may extend from a central portion of the case 110 or the display unit 15*a* toward an outside in a radial direction.

Like the normal analog watch, the hand 143 can display a current time for a user by indicating a letter or scale on the dial. According to the normal analog watch, a dial or a watch face is installed in a center portion of the case 110, and more particularly, in the opening 110*a*. In order for the hand to indicate a time, the dial or watch face includes such indexes as letters, numerals, sales and the like. Yet, according to the smart watch 100, the display unit 15*a*, and more particularly, the display module 15*f* plays a role as a dial on behalf of the normal dial. In particular, a watch face screen including an index I for displaying a time can be outputted through the display unit 15*a*. Hence, as the hand 143 points to the index I on the display unit 15*a*, a current time can be displayed.

Moreover, referring to FIG. 3, the smart watch 100 may include a single physical hand 143 only to display a current time. The single hand 143 may be configured to simply point to a time only without displaying a minute. Yet, the single hand 143 may be configured to point to both an hour and a minute. In particular, as shown in FIG. 3, an interval between indexes indicating one hour may be divided into a multitude of scales. And, the single hand 143 may point to an hour and a minute while moving from one index to another nearby index. For instance, if a space between the index 1 and the index 1 is divided into 12 scales, a single scale can indicate a time interval of 5 minutes between 1 o'clock and 2 o'clock. Hence, the single hand 143 can simultaneously point to the time of 1 o'clock and a corresponding minute by gradually moving from the index 1 to the index 2. Moreover, referring to other drawings (particularly, FIG. 4) except FIG. 3, the smart watch 100 can include a plurality of hands 143 and 144. A plurality of the hands 143 and 144 may become an hour hand indicating an hour and a minute hand indicating a minute, respectively. In particular, the minute hand 144 may be formed longer than the hour hand 143 to be distinguished among the hands. Except the length difference, the minute hand 144 has no differences from the hour hand 143 in disposition, extending direction, and the like. The smart watch 100 may further include a second hand indicating a second in addition to the hour and minute hands 143 and 144. And, the second hand may have the same structural features of the hour and minute hands 143 and 144 mentioned in the foregoing description.

In order to move, as shown in FIG. 5 and FIG. 6, the hands 143 and 144 can be mechanically connected to the movement 141. For instance, the hands 143 and 144 can be connected to the inner mechanical parts of the movement 141 using such a connecting member 149 as a shat, a rod or the like. By rotating the connecting member 149, the movement 141 can gradually rotate the hands 143 and 144 connected thereto, whereby the hands 143 and 144 can point to a corresponding index 132 of the bezel 130 to accurately display a current time. Meanwhile, for the purpose of correction of time error or other purposes, it is necessary for the hands 143 and 144 to be adjusted by a user. Hence, the smart watch 100 may include a crown 142 as a part of the physical watch unit 140. The crown 142 is provided to a lateral portion of the case 110 and is operably connected to the movement 141 through the case 110. In particular, the crown 142 is rotatably connected to the movement 141. As the crown 142 is rotated, the hands 143 and 144 can be moved. Therefore, using the crown 142, the hands 143 and 144 can be adjusted to point to the accurate time. By rotating the crown 142, the hands 143 and 144 can be adjusted or rotated to provide functions different from the watch function. On the other hand, the smart watch 100 may include a push button 111 as an input unit 12*c* (cf. FIG. 1). For example, as shown in FIG. 2, the push button 111 can be disposed on the lateral portion of the case 110 to be adjacent to the push button 111. For example, the push button 111 may be installed in the circuit board 13 or may contact with a switch electrically connected to the circuit board 13. Hence, as the push button 111 is pushed, a prescribed electrical signal is applied to the circuit board 13 and the control unit 18, whereby a function of the mobile terminal can be instructed to the corresponding electronic parts.

The movement 141 can operate in various ways to move the hands 143 and 144. For instance, the movement 141 may be categorized into a mechanical movement or a quartz movement. The mechanical movement can drive the inner parts and the hands 143 and 144 using the mechanical energy saved in a watch spring only. In order to wind up a watch spring, the crown 142 can be rotated. On the other hand, the watch spring may be automatically wound up by a user's motion. Meanwhile, the electronic movement basically uses mechanical parts but requires a battery to supply a power to the quartz and the stepping motor configured to drive the mechanical parts.

Meanwhile, the hands 143 and 144 may be used to provide a function of a smart device as well as to simply display a time. Yet, in order to provide such a function, the hands 143 and 144 should be able to operate by interworking with other electronic parts. In particular, the hand 143 and 144 should be controlled electrically and/or electronically. In more particular, the hands 143 and 144, and more specifically, a motion of the hands 143 and 144 should be moved by the electrical and electronic signals given by the control unit 18. Hence, the hands 143 and 144 can be controlled based on the electromechanic system. According to the definitions and principles of the general electromechanic system, an electrical control of a mechanical part of the smart watch 100 and an electric signal for the same should be understood as encompassing 'electronic control' and 'electronic signal'. For clarity of the following description of mechanical parts, an electronic control and signal or an electronic control only is mentioned. Yet, such mentioning may include an electrical control and signal. Furthermore, it may be appreciated that the electromechanic control is applicable to all mechanical parts of the smart watch 100 including the movement 141 as well as to the hand 143 and 144.

Particularly, since an operation of the hands 143 and 144 can be controlled by the movement 141, it is necessary to electronically control the movement 141 in order to control the hands 143 and 144 electronically. This is why the smart watch 100 can include the movement 141 consisting of the quartz movement. As mentioned in the foregoing description, since the quartz movement uses an electric motor for the hands 143 and 144, a control of the electric motor can be performed electronically. In particular, by controlling the electric motor using an electrical signal, the movement 141 and the hands 143 and 144 can be controlled. For such controls, as shown in FIG. 5 and FIG. 6, the movement 141 can be connected to the circuit board 13 and the control unit 18 through the wiring 13*c*. Hence, the control unit 18 controls the movement 141, thereby controlling the hands 143 and 144 as well. Moreover, as mentioned in the foregoing description, since the touch sensor of the window 15*e* is connected to the control unit 18, the hands 143 and 144 can be substantially controlled. In particular, all the user's finger motions of touching the window 15*e* are sensed through the touch sensor and are then forwarded to the control unit 18. Based on the sensed touch, the control unit 18 can control an operation of the hands 143 and 144 using the movement 141. For instance, a touch input of pushing or swiping the window 15*e* can be used for the purpose of controlling a motion of the hands 143 and 144. In particular, by a touch input, the control unit 18 can control not only an output of the display unit 15*a* but also the hands 143 and 144. Furthermore, in order to secure a further extended input interface, the crown 142 may be connected to the circuit board 13 and the control unit 18 through the wiring 13*d*. Hence, the crown 142 can control the display unit 15*a* via the control unit 18. In particular, all motions generated from manipulating the crown 142 are delivered as signals to the control unit 18. And, the control unit 18 can control the display unit 15*a* based on the inputted signals. For instance, by a manipulation of rotating or pulling/pushing the crown 142, the display unit 15*a* can be manipulated. Therefore, the crown 142 controls the hands 143 and 144 mechanically and is also able to control the display unit 15*a* electronically.

In case that the movement 141 consists of the quartz movement, it may share the battery 19*a* with the electronic parts of the smart watch 100. Yet, since the display unit 15*a* and other electronic parts require a considerable amount of power, it may be difficult to operate the smart watch 100 for a sufficient time with the single battery 19*a*. Eventually, if the electronic parts and the physical watch unit 140 use the same battery 19*a*, both of the electronic device of the smart watch 100 and the physical watch cannot operate for a sufficient time. On the other hand, since the quartz movement 141 uses a considerably small amount of power only, although a general battery is used, an operation of the movement 141 can be guaranteed for several months to several years. Hence, it is preferable that the quartz movement 141 is configured to use a power source different from that of the display unit 15*a* and other electronic parts. According to this configuration, although operations of the electronic parts stop due to the shortage of a power source, the physical watch unit 140 can keep displaying time for a user. In particular, the smart watch 100 can operate as an analog watch at least all the time. In case that the movement 141 uses the power source different from that of the display unit 15*a* or other electronic parts, as shown in FIG. 6, the smart watch 100 may include a $1^{st}$ battery 19*a* configured to supply a power to the display unit 15*a* and the electronic parts and a $2^{nd}$ battery 19*b* configured to supply a power to the movement 141 separately from the $1^{st}$ battery 19*a*.

As mentioned in the foregoing description, the smart watch 100 includes the electronic device configured to provide functions of a smart device and the mechanical device (i.e., the physical watch unit 140) configured to display a time analoguely. Owing to these configurations, the smart watch 100 can show both the physical hands 143 and 144 and the scene/contents of the display unit 15 to a user at the same time while operating. Hence, the smart watch 100 exposes the hands 143 and 144 and the display unit 15*a* to a user appropriately, thereby operating as both of the analog watch and the smart device substantially. Meanwhile, an optimal exposure to a user can be basically determined based on the dispositions of the hands 143 and 144 of the physical watch unit 140 and the display unit 15*a* (i.e., the electronic device).

If the display unit 15*a* is disposed above the hands 143 and 144, since the display unit 15*a* itself is non-transparent, the hands 143 and 144 is blocked by the display unit 15*a* so as to be invisible. Hence, in order for the hand 143 and 144 to be viewed by a user at least, as shown in FIG. 5, the display unit 15*a*, i.e., the display module 15*f* may be disposed below the hands 143 and 144. According to this disposition, the hands 143 and 144 are disposed closer to user's eyes than the display unit 15*a*. In particular, the hands 143 and 144 can be always exposed to user's eyes without being blocked by the display unit 15*a*. Hence, if the display unit 15*a* outputs a scene, the outputted scene and the hands 143 and 144 can be simultaneously viewed by a user at the same time. However, if the window 15*e* is attached to the display module 15*f*, a touch to the window 15*e* for indicating an operation may interfere with the hands 143 and 144 and the hands 143 and 144 may be externally exposed. Hence, the display module 15*a* is disposed below the hands 143 and 144 only, as shown in FIG. 5, and the window 15*e* can be disposed above the hands 143 and 144 together with the touch sensor. According such a final disposition, the smart watch 100 can appropriately protect the hands 143 and 144 by avoiding the interference with the touch while showing the scene and the hand to a user simultaneously.

Since the movement 141 is the component configured to drive the hands 143 and 144, it may be preferable that the movement 141 is disposed as close as possible to the hands 143 and 144 for the mechanical connection to the hands 143 and 144. Yet, since the movement 141 is structurally non-transparent as well, if the movement 141 is disposed above the hands 143 and 144 or the display unit 15*a*, it may block the hands 143 and 144 or the display unit 15*a*. Hence, the movement 141 can be disposed below the display unit 15*a*, i.e., the display module 15*f* In particular, the display unit 15*a*, i.e., the display module 15*f* may be inserted between the hands 143 and 144 and the movement 141. Eventually, the hands 143 and 144 are disposed above the display unit 15*a* and the movement 141 may be disposed below the display unit 15*a*. According to such dispositions, the hands 143 and 144 and the display unit 15*a* (i.e., the display module 150 can be appropriately exposed to a user and the mechanical connection between the hands 143 and 144 and the movement 141 can be secured for the appropriate driving of the hands 143 and 144.

Meanwhile, in order to implement the function as the smart device sufficiently, the display unit 15*a* (i.e., the display module 15*f*) may preferably have a size as large as possible. Since the hand 143 and 144 and the display unit 15*a* are exposed to a user through the opening 110*a*, as shown in FIG. 5 and FIG. 6, the size of the opening 110*a* may become the largest size of the inner parts exposable to a user. Hence, the display unit 15*a* (i.e., the display module 15*f*) can be formed across the opening 110*a* overall. In particular, the display unit 15*a* (i.e., the display module 15*f*) substantially closes the opening 110*a*. Moreover, since the movement is accommodated in the opening 110*a*, the display unit 15*a* can entirely cover the movement 141 disposed below the display unit 15*a* owing to such a size. In order to provide a user with a scene or content as large as possible to fit such a size, the display unit 15*a* may be configured to display a scene or content on a whole surface exposed to the user through the opening 110*a*. In particular, the display unit 15*a* can be configured to display a scene or content on a whole surface of the display unit 15*a* that closes or corresponds to the opening 110*a*. In more particular, the display unit 15*a*, i.e., the display module 15*f* can include pixels formed across the whole surface corresponding to the opening 110*a*. Hence, the scene or contents can be continuously displayed on the whole surface of the display unit 15*a*, which is exposed to a user or corresponds to a size of the opening 110*a*.

Figure 7:
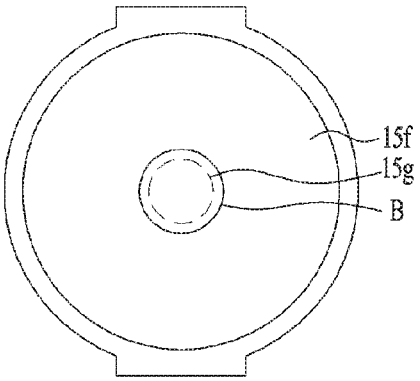
FIG. 7 is a layout of a display module of a smart watch.

Moreover, as discussed in the foregoing description, the movement 141 is disposed below the display unit 15*a*. And, the display unit 15*a* can cover the movement 141 overall to have a possibly large size and a large scene corresponding to the size. According to such a configuration, the display unit 15*a* may interrupt the connection between the movement 141 and the hands 143 and 144 and the movement may have difficulty in being mechanically connected to the hands 143 and 144 by avoiding the display unit 15*a*. Hence, the movement 141 can be connected to the hand 143 and 144 by penetrating the display unit 15*a*, and more particularly, the display module 15*f*. FIG. 7 is a layout of a display module of a smart watch and shows a configuration of the display module 15*f* to allow a connection between the movement 141 and the hands 143 and 144. Hence, with reference to FIG. 7 in addition to FIG. 5 and FIG. 6, the connection between the movement 141 and the hands 143 and 144 is described in detail as follows.

As mentioned in the foregoing description, due to the mutual disposition relations among the hands 143 and 144, the display unit 15*a* and the movement 141, the movement 141 or a portion of the movement 141 can be easily connected to the hand 143 and 144 by penetrating the display unit 15*a* (i.e., the display module 15*f*) configured to cover the movement 141. In order to allow such penetration, the display unit 15*a* (i.e., the display module 15*f*) can include a perforated hole 15*g*. In particular, the perforated hole 15*g* allows a portion of the movement 141 to penetrate the display unit 15*a*, i.e., the display module 15*f* to be connected to the hands 143 and 144. The perforated hole 15*g* may be disposed at the center of the opening 110*a* or the display unit 15*a* (i.e., the display module 15*f*) or may be disposed at another location if necessary. In particular, the movement 141 may include a shaft 149 configured to rotate the hands 143 and 144. The shaft 149 is connected to various gears in the movement 141 and can rotate in accordance with a prescribed setting. The shaft 149 extends through the perforated hole 15*g* toward a top side of the display unit 15*a*, i.e., a top side of the display module 15*f* and can be connected to the hands 143 and 144. In consideration of a diameter of the shaft 149 and other design conditions, the perforated hole 15*g* may have a diameter ranging between minimum 1 mm and maximum 10 mm for example. Moreover, in addition to the perforated hole 15*g*, as shown in FIG. 7, a scene or content non-displayable region, i.e., a pixel not-formed region can be extended as denoted by 'B'. Such a region B can be set depending on a margin for processing the perforated hole 15*g*, a finishing of the processed perforated hole 15*g*, and other design conditions. For instance, the region B may have a diameter of 3.5 mm larger than a diameter of the perforated hole 15*g*.

As mentioned in the foregoing description, the smart watch 100 can include both of the analog watch including the physical watch unit 140 structurally and the smart device including other electronic parts except the physical watch unit 140. Yet, as shown in the example of the display unit 15*a* implementing the dial for the analog watch, most of the parts of the smart watch 100 may be used in common for both of the smart device and the analog watch. Hence, it may be difficult for the smart device and the analog watch to be distinguished from each other and controlled by the parts simply used in the smart watch 100. Instead, the smart watch 100 functionally separates the smart device and the analog watch from each other and is then able to control the smart device and the analog watch based on the functional separation. Particularly, as discussed in the foregoing description, in order to satisfy user's preference and needs for an analog device, it is necessary for functions of an analog watch to be clearly distinguished from other functions. And, the distinguished functions may work as different modes for the smart device 100 and operations of the smart watch 100. Hence, the smart watch 100 and its operation may include an analog mode of providing functions of an analog watch in the smart watch 100 and a smart device mode of providing functions as a smart device different from watch functions in the smart watch 100. Moreover, for clarity and convenience of the description, the analog watch mode and the smart device mode may be named a $1^{st}$ mode and a $2^{nd}$ mode, respectively. The modes classified by aforementioned functions and the definition of the classified modes may intactly apply to a controlling method mentioned in the following description. Likewise, the following additional description based on such classification and definition may intactly apply to the controlling method.

Figure 8:
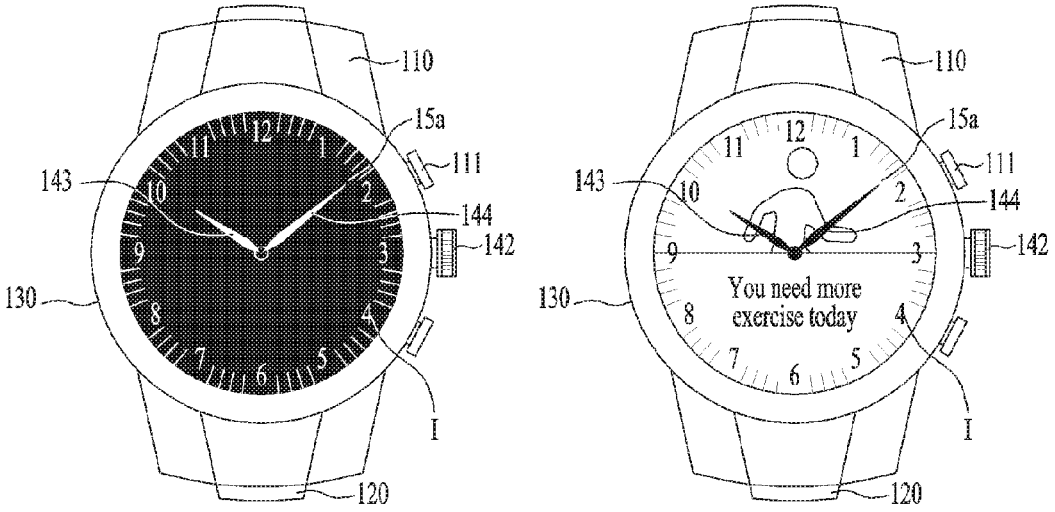
FIG. 8 is a schematic diagram to illustrate an analog watch mode and a smart device mode of a smart watch.
Figure 9:
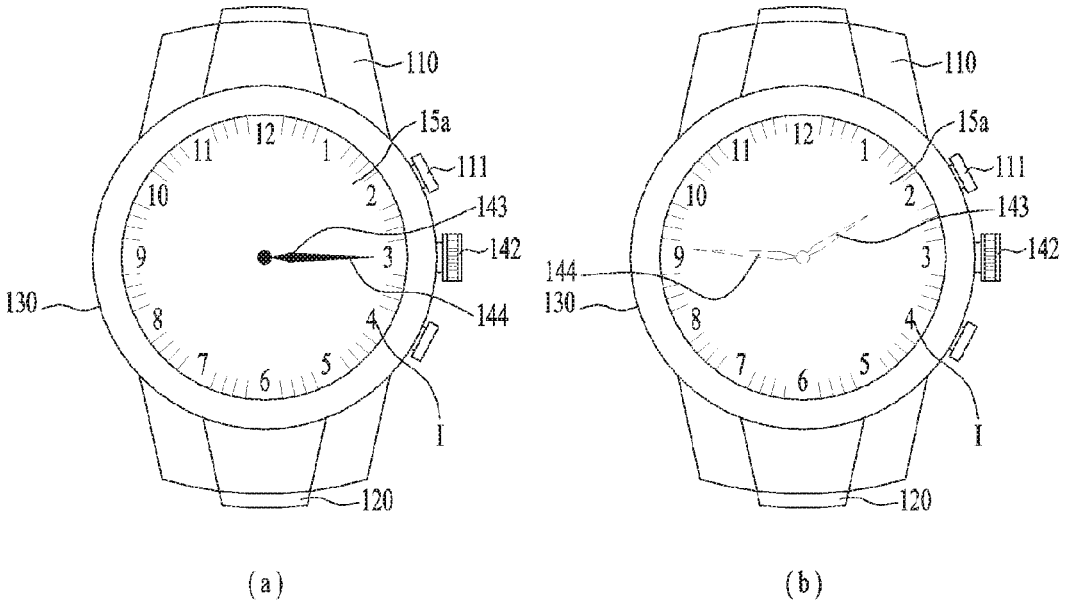
FIG. 9 is a schematic diagram for examples of hands adjusted for a smart device mode of a smart watch.

FIG. 8 is a schematic diagram to illustrate an analog watch mode and a smart device mode of a smart watch, and FIG. 9 is a schematic diagram for examples of hands adjusted for a smart device mode of a smart watch. With reference to these drawings, modes of the smart watch 100 are described in detail as follows.

Referring to FIG. 8 (*a*), the smart watch 100 may provide a function of an analog watch, which uses physical hands 143 and 144, in a $1^{st}$ mode. Referring to FIG. 8 (*b*), the smart watch 100 may provide functions of a smart device, i.e., functions different from the analog watch function, in a $2^{nd}$ mode. As mentioned in the foregoing description, since the hands 143 and 144 and the display unit 15*a* (i.e., the display module 15*f*) are directly exposed to a user, the two different modes mentioned in the foregoing description can be substantially implemented according to operations of the hands 143 and 144 and the display unit 15*a*. In particular, it may important for the hands 143 and 144 and the display unit 15*a* to be appropriately shown to a user according to the $1^{st}$ or $2^{nd}$ mode. Hence, the hands 143 and 144 and the display unit 15*a* may be configured to perform different operations according to the $1^{st}$ mode and the $2^{nd}$ mode, respectively. For the operation according to the corresponding mode, the $1^{st}$ and $2^{nd}$ modes may include $1^{st}$ and $2^{nd}$ display settings for controlling operations of the display unit 15*a*, respectively. For the same reason, the $1^{st}$ and $2^{nd}$ modes may include $1^{st}$ and $2^{nd}$ hand settings for controlling the operation of the hands 143 and 144, respectively. Moreover, as mentioned in the foregoing description, for the different operations to implement the different functions in the $1^{st}$ and $2^{nd}$ modes, respectively, the $1^{st}$ display and hand settings may be different from the $2^{nd}$ display and hand settings.

In particular, a display setting embraces all configurations of a scene/content displayed on the display unit 15*a*. Namely, the display setting may include all of types, dispositions, sizes and colors of an interface and items included in the scene/content displayed on the display unit 15*a* as well as the scene/content displayed on the display unit 15*a*. Hence, the $1^{st}$ display setting and the $2^{nd}$ display setting may have different scenes/contents, different interfaces, different items and the like, respectively. For instance, as shown in FIG. 8 (*a*), the $1^{st}$ display setting may include a watch face containing an index I at which the physical hands 143 and 144 are pointed to indicate a current time. Hence, in the $1^{st}$ mode, the smart watch 100 can provide a user with full functions as an analog watch. On the other hand, referring to FIG. 8 (*b*), the $2^{nd}$ display setting may include a screen configured for a smart device function. In particular, as shown in the drawing, a screen and content appropriate for a provided function of a smart device is displayed, whereby an intended function of a smart device in a $2^{nd}$ mode can be provided to a user. Eventually, according to the $1^{st}$ display setting mentioned in the above description, the display unit 15*a* may provide a screen configured to display a time through the hands in the $1^{st}$ mode. According to the $2^{nd}$ display setting mentioned in the above description, the display unit 15*a* may provide a screen configured for a function other than the analog watch function, and more particularly, for a function as a smart device in the $2^{nd}$ mode.

On the other hand, the hand setting may embrace all operations of the hands 143 and 144 related to the $1^{st}$ mode and the $2^{nd}$ mode. Since the hands 143 and 144 are disposed on the display unit 15*a* in a manner of rotating, the hand setting may basically include the rotation and disposition of the hands 143 and 144. Hence, the $1^{st}$ hand setting and the $2^{nd}$ hand setting may include different dispositions of the hands 143 and 144, respectively. For instance, as shown in FIG. 8 (*a*), the $1^{st}$ hand setting can dispose the hands to point at an index corresponding to a current time displayed on the display unit 15*a*. Hence, in the $1^{st}$ mode shown in FIG. 8 (*a*), the smart watch 100 can provide a user with a full function as an analog watch. Meanwhile, in most cases, it is able to perform the function of the smart device, i.e., the $2^{nd}$ mode, using the screen and interface provided by the display unit 15*a* only. Hence, the physical hands 143 and 144 may point at the screen and interface on the display unit 15*a* or interrupt manipulations of the screen and interface. For such a reason, the $2^{nd}$ hand setting can adjust the hands 143 and 144 not to interfere with the screen of the display unit 15*a* during the $2^{nd}$ mode. In particular, for example, as shown in FIG. 9 (*a*), the hands 143 and 144 may be aligned in a line. In particular, one hand 143 may overlap the other hand 144. Hence, it is able to minimize a portion of the display unit 15*a* blocked by the hands 143 and 144. Moreover, referring to FIG. 9 (*b*), the hands 143 and 144 may be changed to become transparent. For instance, the hands 143 and 144 may be formed of OLED or optical fiber, which can become transparent selectively. As the hands 143 and 144 are changed to become transparent, the screen of the display 15*a* can avoid being blocked. Hence, the $2^{nd}$ hand setting can adjust disposition or transparency of the hands 143 and 144 to avoid interference with the screen of the display unit 15*a* during the $2^{nd}$ mode. For the same reason, the $1^{st}$ hand setting and the $2^{nd}$ hand setting include different dispositions or transparencies of the hands, respectively. By the adjustment according to the $2^{nd}$ hand setting, the display unit 15*a* can be maximally used while the physical hands 143 and 144 are used. Hence, the smart device function intended in the $2^{nd}$ mode can be provided to a user. Eventually, according to the aforementioned $1^{st}$ and $2^{nd}$ hand settings, the hands 143 and 144 may point at an index I displayed on the display unit 15*a* to display a current time during the $1^{st}$ mode and may not interfere with a screen provided by the display unit 15 to provide a function of the smart device appropriately during the $2^{nd}$ mode.

Meanwhile, although an operation of structurally providing both an analog watch and a smart device can be primarily achieved by the structure of the smart watch 100 mentioned in the foregoing description, the intended technical object needs to be supported by an appropriate control in consideration of the structure and features of the watch 100 in order for the object to be achieved more specifically. In implementing a function, the smart watch 100 is basically accompanied by a mutual interaction with a user. Hence, through the optimization of various controls including user environment and user interface, the above-mentioned technical object can be achieved more effectively and efficiently. Furthermore, such user's experiences of the smart watch 100 as use facilitation, use convenience and the like can be remarkably improved. In particular, the optimal control can considerably enhance a product value of the smart watch 100. For such a reason, the method of controlling the smart watch 100 shown in FIGS. 1 to 9 is developed and shall be described in the following with reference to the accompanying drawings in addition to FIGS. 1 to 9. In doing so, FIGS. 1 to 9 and the descriptions with reference to FIGS. 1 to 9 are basically referred to by being included in the following description of the controlling method with reference to the corresponding drawings.

Figure 10:
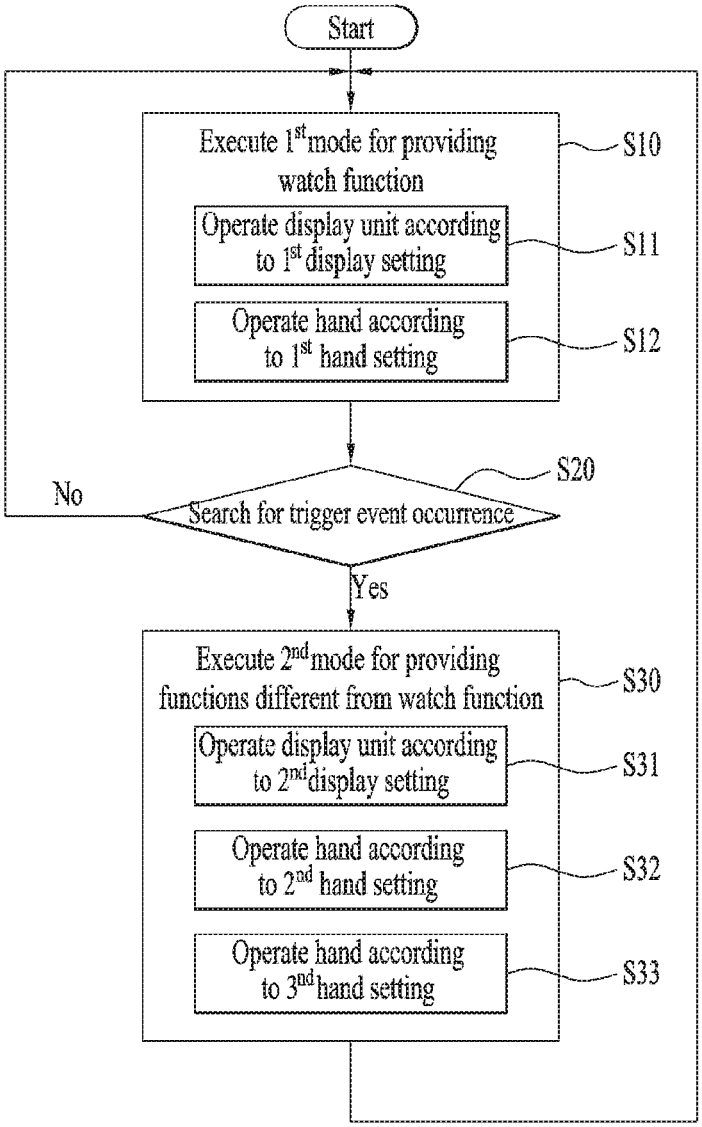
FIG. 10 is a flowchart to schematically illustrate one example of a smart watch controlling method described in the present application.

FIG. 10 is a flowchart to schematically illustrate one example of a smart watch controlling method described in the present application. The controlling method described with reference to FIG. 10 in the following controls operations of the aforementioned components, i.e., various parts and is able to provide intended functions based on these operations. Hence, the operations and functions related to the controlling method can be regarded not only as the features of the controlling method but also as the features of the corresponding structural components related to the operations and functions. Particularly, as mentioned in the foregoing description of the structure of the smart watch 100, the controller 18 may be called one of various names such as a control unit, a control device and the like and is able to control all components of the smart watch 100 to perform a prescribed operation. Hence, the controller 18 substantially controls the steps of all methods described in the present application and all the steps described in the following may become the features of the controller 18. In particular, although all steps and detailed features of the steps described in the following may not be described as performed by the controller 18 or the smart watch 100, they should be regarded as the features of the smart watch 100 or the controller 18. Moreover, the controlling method describes operations and functions of the different modes (i.e., the $1^{st}$ and $2^{nd}$ modes mentioned in the foregoing description) and various sub-steps included in the different modes according to the provided functions. Yet, the classification according to the $1^{st}$ and $2^{nd}$ modes is not absolute. In particular, if it is not explicitly described that a function and operation according to one of the modes is contradictory to or specially applicable to another mode, the corresponding function and operation may be applicable to another mode. In particular, the function and operation according to the $1^{st}$ mode may be employed in part by the $2^{nd}$ mode if necessary.

First of all, in order to use the smart watch 100, a user can dispose the watch 100 on a body of the user. In particular, the user can wear the watch 100 on user's wrist, and a controlling method is described by referring to the watch 100 worn on user's wrist. Meanwhile, the user may use the smart watch 100 held by user's hand instead of wearing the smart watch 100 on user's body. Hence, controlling methods described in the following may apply to all types of dispositions on or contacts with user's body [e.g., a type of wearing on user's wrist, etc.].

Figure 11:
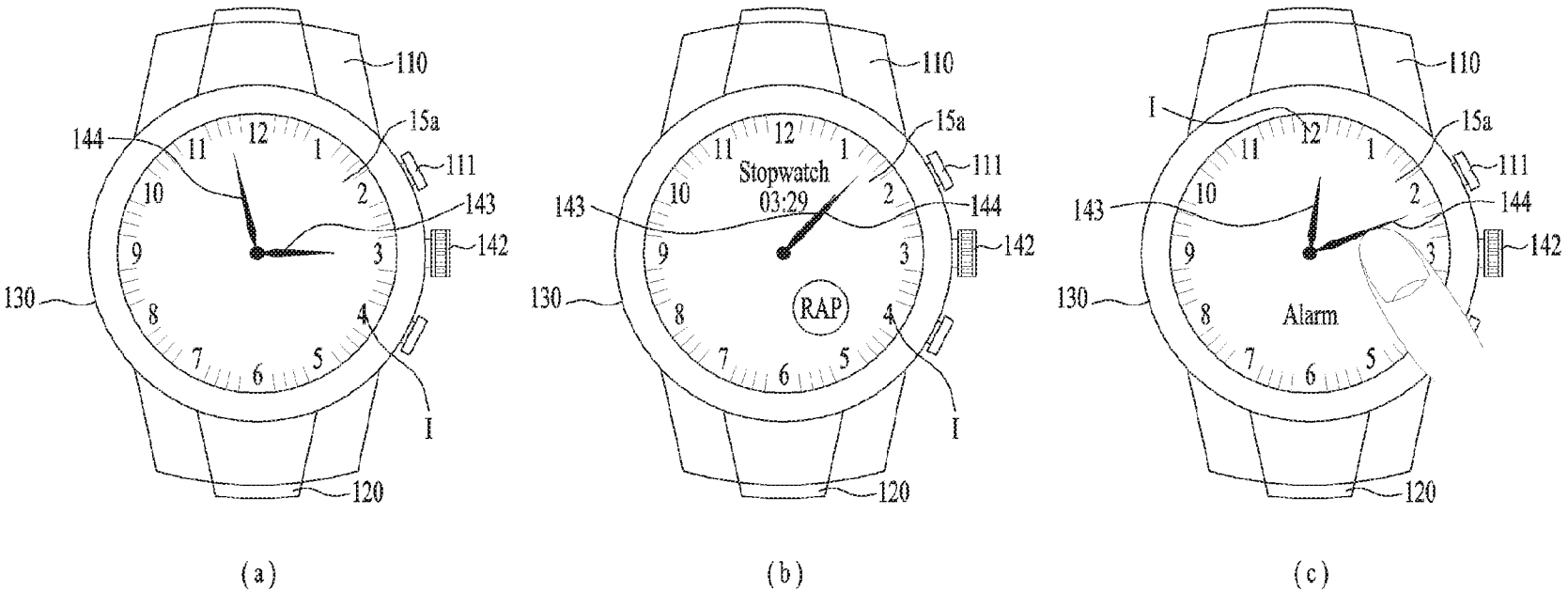
FIG. 11 is a schematic diagram to illustrate one example of a smart watch in $1^{st}$ mode of providing a watch function.

After the user has worn the smart watch 100, the smart watch 100 can perform a $1^{st}$ mode for providing an analog watch function [S10]. Regarding the $1^{st}$ mode, FIG. 11 is a schematic diagram to illustrate one example of a smart watch in $1^{st}$ mode of providing a watch function.

As mentioned in the foregoing description, the smart watch 100 can include both an analog watch structurally consisting of the physical watch unit 140 and a smart device consisting of various electronic parts other than the physical watch unit 140. Hence, the smart watch 100 functionally separates the smart device and the analog watch included in the smart watch 100 from each other and is then able to control them based on the functional separation. Particularly, as discussed in the foregoing description, in order to satisfy user's preference and taste for the analog device, a function as an analog watch needs to be clearly distinguished from other functions. Hence, the smart watch 100 and an operation of the smart watch 100 may include a $1^{st}$ mode of providing a function of the analog watch in the smart watch 100. In particular, the $1^{st}$ mode operates the physical hands 143 and 144 by the movement 141 and a current time can be displayed by the operation of the physical hands 143 and 144. Moreover, a most basic function of the smart watch 100 may be a function of providing a current time. Hence, unless a function as a smart device is specially requested, i.e., if a trigger event mentioned in the following description fails to occur, the smart watch 100 is able to execute the $1^{st}$ mode to operate as the analog watch. By contrast with the $1^{st}$ mode, the smart watch 100 and an operation of the smart watch 100 may include a $2^{nd}$ mode of providing functions as the smart device, which is different from the watch function. And, the $2^{nd}$ mode shall be described in detail later.

As mentioned in the foregoing description, since the hands 143 and 144 and the display unit 15*a* (i.e., the display module 15*f*) are directly exposed to a user, the 2 different modes mentioned in the foregoing description can be implemented according to the operations of the hands 143 and the display unit 15*a*. Hence, the display unit 15*a* and the hands 143 and 144 can be basically configured to perform different operations according to the functions (i.e., the $1^{st}$ mode and the $2^{nd}$ mode) provided by the smart watch 100, respectively. For such an operation according to a mode, the $1^{st}$ mode may include a $1^{st}$ display setting for controlling an operation of the display unit 15*a* and the $2^{nd}$ mode may include a $2^{nd}$ display setting for controlling an operation of the display unit 15*a*. For the same reason, the $1^{st}$ mode may include a $1^{st}$ setting for controlling operations of the hands 143 and 144 and the $2^{nd}$ mode may include a $2^{nd}$ setting for controlling operations of the hands 143 and 144. Moreover, as mentioned in the foregoing description, for different operations for implementing different functions in the $1^{st}$ and $2^{nd}$ modes, respectively, the $1^{st}$ display and hand settings may be different from the $2^{nd}$ display and hand settings.

In particular, a display setting embraces all configurations of a scene/content displayed on the display unit 15*a*. Namely, the display setting may include all of types, dispositions, sizes and colors of an interface and items included in the scene/content displayed on the display unit 15*a* as well as the scene/content displayed on the display unit 15*a*. Hence, the $1^{st}$ display setting and the $2^{nd}$ display setting may have different scenes/contents, different interfaces, different items and the like, respectively. Hence, the $1^{st}$ and $2^{nd}$ display settings may have different scenes/contents, different interfaces, different items and the like, respectively. On the other hand, a hand setting can embrace all operations of the hands 143 and 144 related to the $1^{st}$ and $2^{nd}$ modes. Since the hands 143 and 144 are disposed on the display unit 15*a* in a manner of rotating, the hand setting can basically include rotations and dispositions of the hands 143 and 144. Hence, the $1^{st}$ hand setting and the $2^{nd}$ hand setting may basically include different dispositions of the hands 143 and 144, respectively.

For actual examples of the display setting and the hand setting, the $1^{st}$ display setting and the $1^{st}$ hand setting in a $1^{st}$ mode executing step S10 are described in detail with reference to FIG. 11 as follows.

First of all, in order to implement a $1^{st}$ mode, the smart watch 100 can operate the display unit 15*a* according to a $1^{st}$ display setting [S11]. For instance, referring to FIG. 11 (*a*), the $1^{st}$ display setting may include a watch face. Such a watch face or dial may include an index I at which the physical hands 143 and 144 are pointed to indicate a current time. The $1^{st}$ display setting according to the $1^{st}$ mode is shown in FIG. 8 (*a*). Hence, the smart watch 100 in the $1^{st}$ mode, as shown in FIG. 11 (*a*), can provide a user with a complete dial or face for an analog watch.

Moreover, the $1^{st}$ display setting can adjust a scene/content of the display unit 15*a* to avoid interfering with the hands 143 and 144. In particular, the display unit 15*a* can include a different interface or items in addition to the index I. Yet, if the interface or the items are disposed in a range of rotational radiuses of the hands 143 and 144, the interface or the items may interfere with the hands 143 and 144. Hence, the additional interface or items can be disposed outside the rotational radiuses of the hands 143 and 144. On the other hand, the additional interface or items may be shifted in accordance with locations changes of the hands 143 and 144 to avoid being blocked by the hands 143 and 144. Moreover, the $1^{st}$ display setting can adjust a screen of the display unit 15*a* to emphasize the hands 143 and 144. In particular, in order to emphasize the hands 143 and 144, a background displayed on the display unit 15*a* may change in color, size and/or the like. For instance, if the hands 143 and 144 are in bright color, as shown in FIG. 8 (*a*), the display unit 15*a* may have a dark background overall. On the contrary, the index I may be represented in bright color to be contrast with the dark background. Hence, the hands 143 and 144 and the index I can be emphasized against the dark background. Besides, since a bright background consumes a relatively more power, if a dark background is adopted, it may be able to save a power. As mentioned in the foregoing description, the $1^{st}$ display setting in the $1^{st}$ mode prevents the screen of the display unit 15*a* from interfering with the hands 143 and 144 and rather emphasizes the hands 143 and 144, thereby enabling the hands 143 and 144 to be seen well to a user.

Together with the step S11 of executing the $1^{st}$ display setting, in order to implement the $1^{st}$ mode, the smart watch 100 can activate the hands 143 and 144 according to a $1^{st}$ hand setting [S12]. For instance, referring to FIG. 11 (*a*), the $1^{st}$ hand setting can dispose the hands to point at an index I corresponding to a current time displayed on the display unit 15*a*. The $1^{st}$ hand setting according to the $1^{st}$ mode is shown in FIG. 8 (*a*) as well. Hence, in the $1^{st}$ mode shown in FIG. 11 (*a*), the smart watch 100 can provider a user with a complete function as an analog watch by the watch face and hand disposition/shift according to the $1^{st}$ display and hand settings.

Meanwhile, a watch can provide various functions as well as a time display using the hands 143 and 144. Such additional functions are called complication according to horology. For example, chronograph, calendar and the like can be included in the complication. Moreover, the chronograph may include such functions as a stopwatch, a timer, an alarm and the like for example. Hence, the $1^{st}$ mode executing step S10 can be configured to provide the aforementioned additional functions related to a watch function as well as a basic watch function. For instance, referring to FIG. 11 (*b*) and FIG. 11 (*c*), a function such as a stopwatch, an alarm or the like can be provided in the $1^{st}$ mode. According to the $1^{st}$ mode and the configuration of the $1^{st}$ mode executing step S10, the $1^{st}$ display setting can provide a screen, an interface and the like configured to implement the additional functions. Likewise, a $2^{nd}$ hand setting can provide dispositions and operation of the hands 143 and 144 configured to implement the additional functions. For instance, referring to FIG. 11 (*b*), in case that the smart watch 100 provides a function of a stopwatch, the hands 143 and 144 can indicate a corresponding index by rotating to correspond to a time to display times of elapse. Moreover, referring to FIG. 11 (*c*), in case that the smart watch 100 provides a function of alarm, the hands 143 and 144 can point at a corresponding index I to display or set a time for notification of an approaching event.

Figure 12:
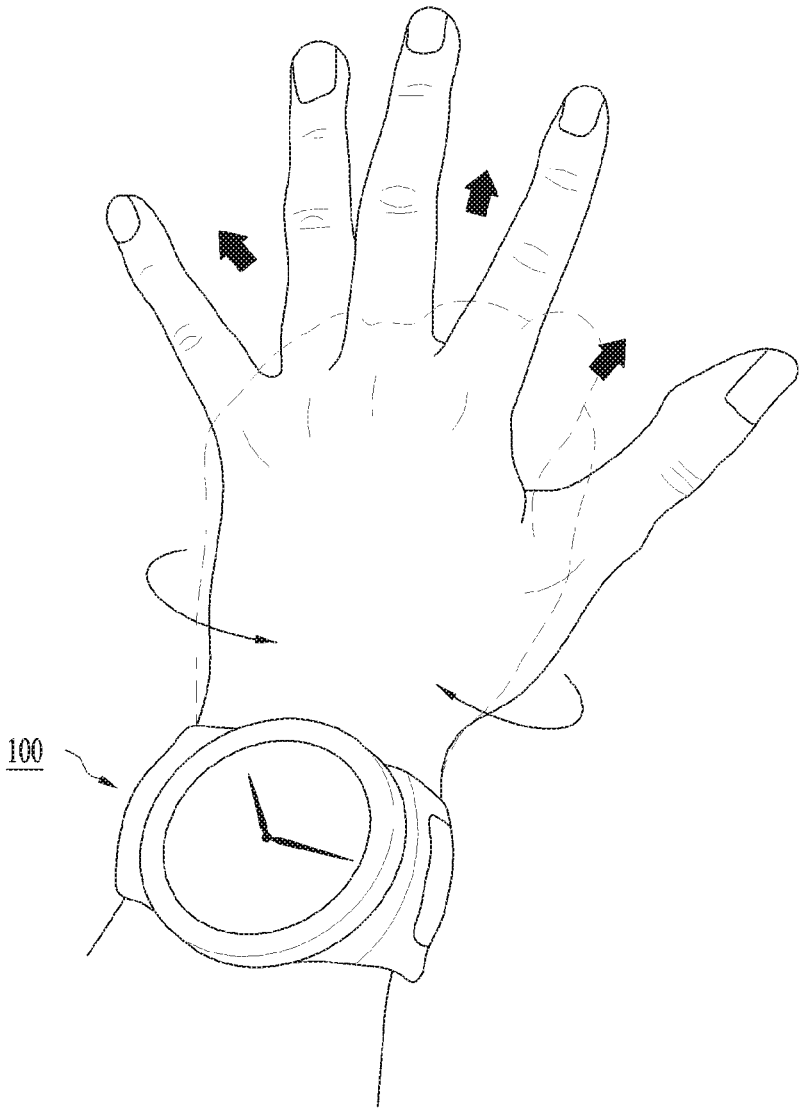
FIG. 12 and FIG. 13 are schematic diagrams to illustrate examples of an event for switching a smart watch to a $2^{nd}$ mode from a $1^{st}$ mode.
Figure 13:
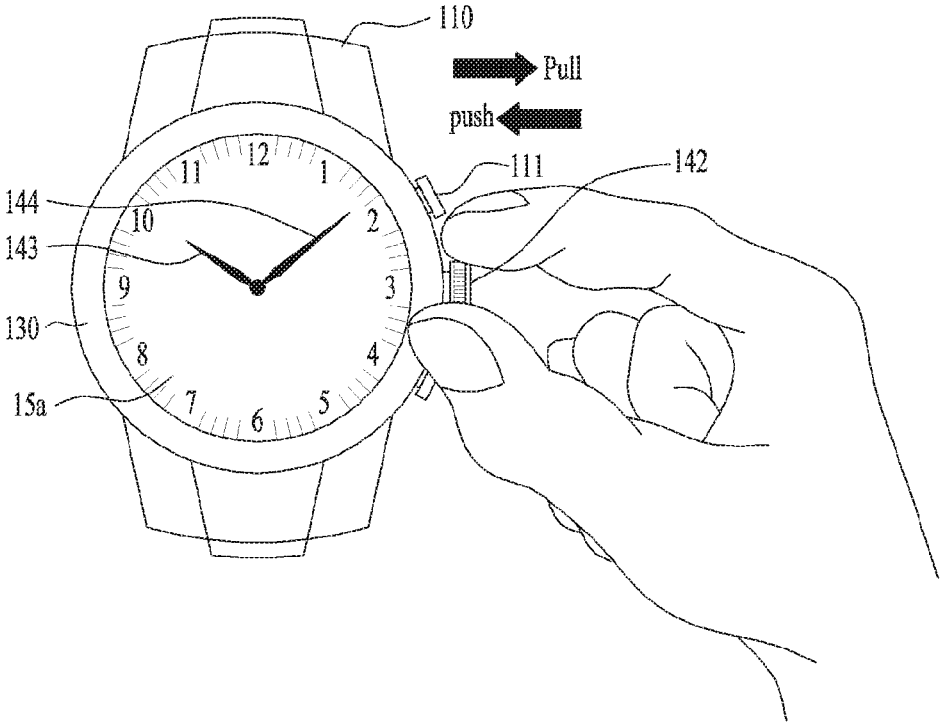

While the $1^{st}$ mode executing step S10 is performed, the smart watch 100 can search for a prescribed event [S20]. In the searching step S20, the event may include an event of requesting a function of the $1^{st}$ mode, i.e., a function other than the watch function. Since such an event pages a $2^{nd}$ mode of substantially performing the function other than the watch function, which is described in the following, it may be a sort of a trigger event for switching the smart watch 100 from the $1^{st}$ mode to a $2^{nd}$ mode. Actual examples of the trigger event are shown in FIG. 12 and FIG. 13, and the searching step S20 is described in detail with reference to these drawings as follows. FIG. 12 and FIG. 13 are schematic diagrams to illustrate examples of an event for switching a smart watch to a $2^{nd}$ mode from a $1^{st}$ mode.

First of all, in the searching step S20, the smart watch 100 can search for an event for a user to manually switch the smart watch 100 to the $2^{nd}$ mode. For instance, referring to FIG. 12, in order to switch the smart watch 100 to the $2^{nd}$ mode, a user may fold or unfold fingers. And, a motion of folding and unfolding fingers may become one event for switching to the $2^{nd}$ mode. Moreover, a user may twist user's wrist for switching to the $2^{nd}$ mode. Such a user's gesture, and more particularly, hand's motions can be sensed by a motion sensor (e.g., an infrared motion sensor, etc.) installed in the smart watch 100, and the controller 18 can control the smart watch 100 to enter the $2^{nd}$ mode in response to the sensed motion, i.e., a command for a mode switching. A user's gesture different from the hand's motion may be used as a manual input for switching to the $2^{nd}$ mode. Moreover, for example, referring to FIG. 13, in order to switch the smart watch 100 to the $2^{nd}$ mode, a user pulls the crown 142 and is then able to push it back. As mentioned in the foregoing description, since the crown 142 is connected to the circuit board 13 and the control unit 18 through the wiring 13*d*, such an operation may be inputted as a command to the controller 18. In response to such a command, the controller 180 can control the smart watch 100 to enter the $2^{nd}$ mode. Moreover, the manual input, i.e., a hand's motion or a manipulation of the crown 142 may apply to switching the smart device 100 to the $1^{st}$ mode from the $2^{nd}$ mode in a similar mechanism. In particular, if the same hand's motion or the same manipulation of the crown 142 occurs in the $2^{nd}$ mode, the smart watch 100 may enter the $1^{st}$ mode.

Meanwhile, in the searching step S20, the smart watch 100 may search for an event for automatically switching the smart watch 100 to the $2^{nd}$ mode. For example, referring to FIG. 15 (*a*) and FIG. 15 (*b*), the smart watch 100 may receive a prescribed notification. Moreover, the smart watch 100 may receive an alert or an incoming call. The notification, alert or incoming call may be set as a default at the smart watch 100 or received from another device or network. If the smart watch 100 receives such an event, the controller 18 determines whether a function as a smart device is requested and is able to control the smart watch 100 to enter the $2^{nd}$ mode automatically. Such an event for an automatic switching may include any event received from the smart watch 100, another device or a network in addition to one of the above-mentioned events.

Figure 14:
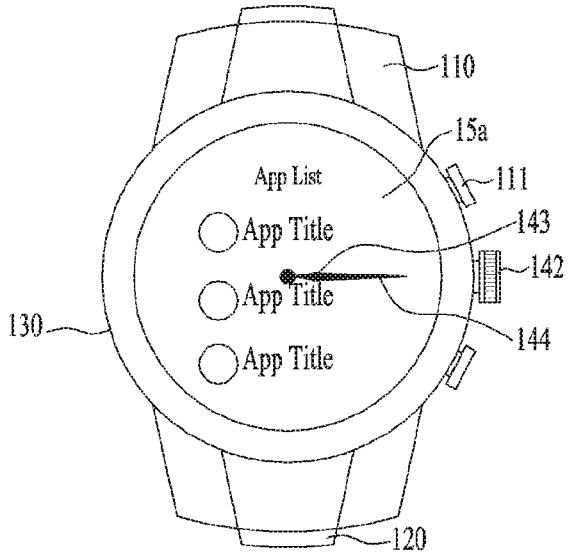
FIG. 14 is a schematic diagram to illustrate one example of a smart watch in a $2^{nd}$ mode of providing a function as a smart device other than a watch function.
Figure 15:
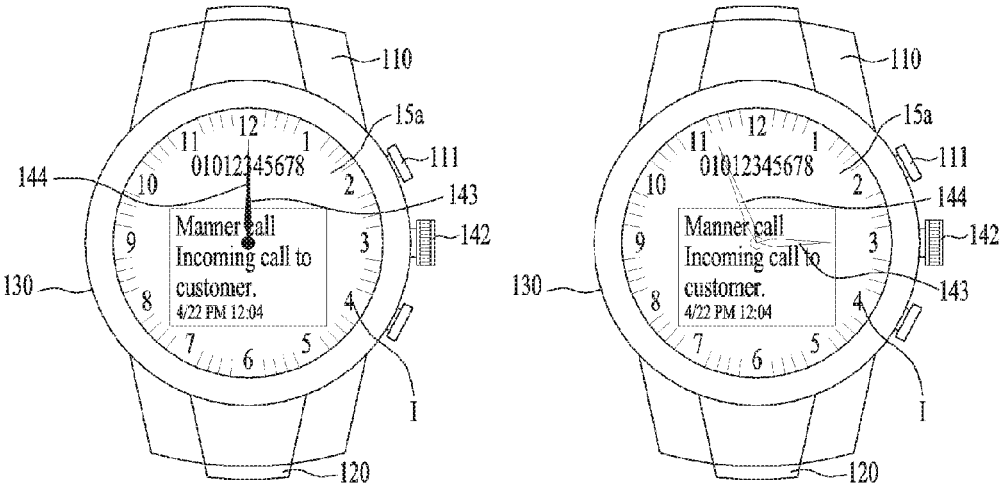
FIG. 15 is a schematic diagram to illustrate other examples of the smart watch in the $2^{nd}$ mode.

If a preset trigger event is found in the searching step S20, the smart watch 100 can execute the $2^{nd}$ mode for providing functions different from the watch function [S30]. In particular, the executing step S30 can execute the $2^{nd}$ mode for providing smart device functions different from the analog watch function that uses the physical hands 143 and 144. Regarding the $2^{nd}$ mode, FIG. 14 is a schematic diagram to illustrate one example of a smart watch in a $2^{nd}$ mode of providing a function as a smart device other than a watch function and FIG. 15 is a schematic diagram to illustrate other examples of the smart watch in the $2^{nd}$ mode.

As mentioned in the foregoing description, the $2^{nd}$ mode may include a $2^{nd}$ display setting and a $2^{nd}$ hand setting configured to perform an intended function as a smart device. In order to implement different functions of the $1^{st}$ and $2^{nd}$ modes, the $2^{nd}$ display setting and the $2^{nd}$ hand setting of the $2^{nd}$ mode may be different from the $1^{st}$ display setting and the $1^{st}$ hand setting of the $1^{st}$ mode.

For actual example of the display and hand settings, the $2^{nd}$ display setting and the $2^{nd}$ hand setting in the $2^{nd}$ mode executing step S30 are described in detail as follows. First of all, in order to implement the $2^{nd}$ mode, the smart watch 100 can operate the display unit 15*a* according to the $2^{nd}$ display setting [S31]. In particular, referring to FIG. 14 and FIG. 15, the $2^{nd}$ display setting can provide a screen and content configured for a smart device function intended in the $2^{nd}$ mode. For instance, as shown in FIG. 14, the display unit 15*a* can provide a list of available applications. Moreover, as shown in FIG. 15, the display unit 15*a* can provide a screen on which a prescribed notification is displayed. Thus, the $2^{nd}$ display setting can display a screen and content appropriate for an intended function as a smart device.

Hence, the $2^{nd}$ mode and the step S30 of executing the $2^{nd}$ mode can provide a user with an intended function of a smart device.

Moreover, in the operating step S31, the $2^{nd}$ display setting can provide a screen configured for a function related to the event found in the searching step S20. For instance, in case that the smart watch 100 is used as an analog watch according to the $1^{st}$ mode, an forced end of the $1^{st}$ mode can be interpreted as an intention to use a function as a smart device of the smart watch 100. Hence, as shown in FIG. 12 and FIG. 13, the event of manually switching the smart watch 100 to the $2^{nd}$ mode may correspond to a sort of a forced end of the $1^{st}$ mode for intending to launch an application of the smart watch 100. For such a reason, as shown in FIG. 14, the $2^{nd}$ display setting can control the display unit 15*a* to provide a list of applications corresponding to a base of a function of a smart device. Meanwhile, for example, in case that an event (e.g., a notification) for automatically switching to the $2^{nd}$ mode occurs, as shown in FIG. 15, the $2^{nd}$ display setting can provide a screen for a function related to the occurring notification. In particular, the $2^{nd}$ display setting can provide a screen for displaying the occurring notification. Hence, as mentioned in the foregoing description, the $2^{nd}$ display setting, i.e., the smart watch 100 can provide a screen configured for a function directly related to a found event. Moreover, the $2^{nd}$ display setting, i.e., the smart watch 100 can provide a screen configured for a function indirectly related to the found event. For instance, the smart watch 100 can provide an interface capable to paging other functions associated with the notification in executing the $2^{nd}$ mode [not shown in the drawing].

Together with the execution S31 of the $2^{nd}$ display setting mentioned in the above description, in order to implement the $2^{nd}$ mode, the smart watch 100 can operate the hands 143 and 144 according to the $2^{nd}$ hand setting [S32]. In most cases, a function of a smart device, i.e., the $2^{nd}$ mode can be executed using a screen and interface provided by the display unit 15*a* only. Hence, the physical hands 143 and 144 may block the screen and interface on the display unit 15*a* or interrupt manipulation of the screen and interface. For such a reason, the $2^{nd}$ hand setting can adjust the hands 143 and 144 not to interference with the screen and content of the display unit 15*a* during the $2^{nd}$ mode. In particular, as shown in FIG. 9 (*a*), FIG. 14 and FIG. 15 (*a*), the hands 143 and 144 may be aligned in a line. In particular, one hand 143 may overlap the other hand 144. In particular, if the smart device 100 is switched to the $2^{nd}$ mode from the $1^{st}$ mode, the hands 143 and 144 can be aligned in a line by rotating from locations for pointing at a current time. Hence, a portion of the display unit 15*a* blocked by the hands 143 and 144 can be minimized. Moreover, as shown in FIG. 15 (*a*), if the hands 143 and 144 point at 12 o'clock, the hands 143 and 144 are aligned to be harmonized with a viewed screen of the display unit 15*a*. Hence, the $2^{nd}$ hand setting can dispose each of the hands 143 and 144 to point at 12 o'clock. And, interference with the screen of the display unit 15*a* can be minimized by such a disposition.

Moreover, referring to FIG. 9 (*b*) and FIG. 15 (*b*), the hands 143 and 144 can be changed to become transparent. For instance, the hands 143 and 144 may be formed of transparent display or optical fiber, which can become transparent selectively. In particular, the hands 143 and 144 may be formed of a transparent display such as transparent OLED, and is able to adjust transparency of hands 143 and 144 by adjusting overall color. For instance, if the transparent display represents a dark background color, the hands 143 and 144 become non-transparent and can be used to display a time in the $1^{st}$ mode. Yet, if the transparent display is turned off, the hands 143 and 144 become transparent owing to transparency of the hands 143 and 144 and may not interference with the screen of the display unit 15*a* in the $2^{nd}$ mode. Moreover, in case that the hands 143 and 144 are formed of optical fiber, the hands 143 and 144 can adjust transparent by applying light. In particular, if light in prescribed color is applied to the optical fiber, the hands 143 and 144 have color of the corresponding light owing to the color of the light and can be used to display a time in the $1^{st}$ mode. Yet, if the light is not applied, the hands 143 and 144 become transparent owing to transparency of the hands 143 and 144 and may not interfere with the screen of the display unit 15*a* in the $2^{nd}$ mode.

The $2^{nd}$ hand setting may not block the screen of the display unit 15*a* by changing the hands 143 and 144 transparently. Hence, the $2^{nd}$ hand setting can adjust the disposition or transparency of the hands 143 and 144 to avoid interfering with the screen of the display unit 15*a* during the $2^{nd}$ mode. Owing to the adjustments of the disposition and transparency of the $2^{nd}$ hand setting, the $1^{st}$ hand setting and the $2^{nd}$ hand setting differ from each other in disposition or transparency of the hands. Thus, owning the adjustment according to the $2^{nd}$ hand setting, the display unit 15*a* can be maximally used while using the physical hands 143 and 144, whereby an intended function of a smart device in the $2^{nd}$ mode can be provided to a user.

Figure 16:
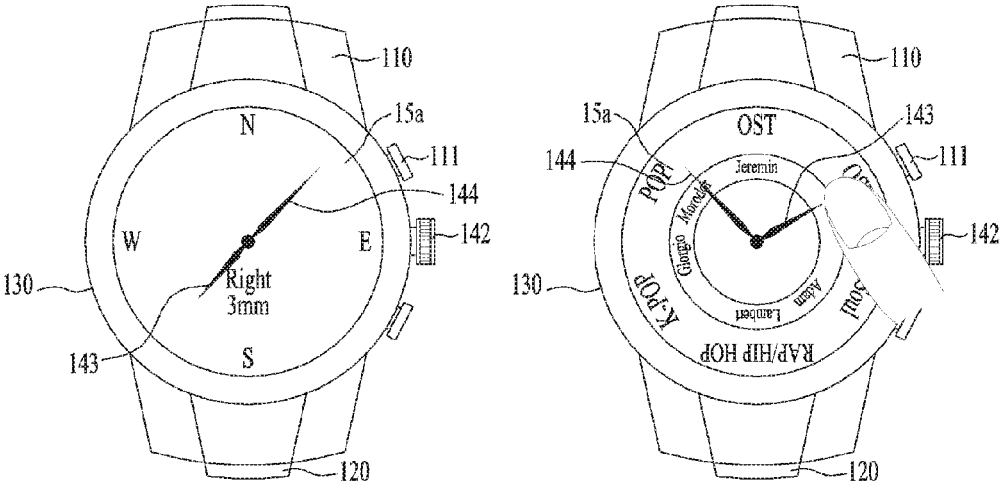
FIG. 16 is a schematic diagram to illustrate examples of a smart watch in $2^{nd}$ mode of providing a function of using physical hands.

Meanwhile, the hands 143 and 144 can perform various functions as well as a function of simply displaying a time. For instance, considering the physical shapes of the hands 143 and 144, it may be able to use the hands 143 and 144 to select or point at items on an interface provided by the display unit 15*a*. In particular, the hands 143 and 144 may perform a function of indicating a time and may also work as a portion of an interface for a function of a smart device. Hence, in order to provide a function different from the watch function, the $2^{nd}$ mode may include a $3^{rd}$ hand setting that uses the hands 143 and 144. In particular, the $3^{rd}$ hand setting may be configured to substantially use the hands 143 and 144, whereas the $2^{nd}$ hand setting is configured not to use the hands 143 and 144. According to the $3^{rd}$ hand setting, the smart watch 100 can operate the hands 143 and 144 to implement the $2^{nd}$ mode [S33]. Regarding this, FIG. 16 is a schematic diagram to illustrate examples of a smart watch in $2^{nd}$ mode of providing a function of using physical hands.

First of all, the $3^{rd}$ hand setting can use the hands 143 and 144 as an indicator that indicates a prescribed information. For example, as shown in FIG. 16 (*a*), the hands 143 and 144 may be controlled to indicate bearings or points of the compass in the $2^{nd}$ mode. The hands 143 and 144 can display a progress stage, a quantity and the like as well as the bearing indication. On the other hand, the $3^{rd}$ hand setting may use the hands 143 and 144 as a selector for selecting an object displayed on the display unit 15*a*. For example, as shown in FIG. 16 (*b*), the hands 143 and 144 may be used to select a desired item from a music application. In addition, the hands 143 and 144 may be used as a cursor for selecting a menu or inputting an information.

Once the $2^{nd}$ mode or the $2^{nd}$ mode executing step S30 is ended, the smart watch 100 can be switched to the $1^{st}$ mode again [S10]. When the intended function of the smart watch is completed, the smart watch 100 may be switched to the $1^{st}$ mode from the $2^{nd}$ mode. The events in the searching step S30 mentioned in the foregoing description may be similarly applicable to such a switching. In particular, the smart watch 100 can be manually switched to the $1^{st}$ mode from the $1^{st}$ mode. For instance, the hand's motion or the manipulation of the crown 142, which is described with reference to FIG. 12 or FIG. 13, can switch the smart watch 100 to the $1^{st}$ mode from the $2^{nd}$ mode. Moreover, such a switching can be forcibly performed by the hand's motion or the crown manipulation while the $2^{nd}$ mode is being performed or when the $2^{nd}$ mode is naturally completed. On the other hand, the smart watch 100 can be automatically switched to the $1^{st}$ mode from the $2^{nd}$ mode. For example, as shown in FIG. 15, after a notification has been received [i.e., a trigger event has occurred] and a switching to the $2^{nd}$ mode has been then performed by the event occurrence, if a predetermined time expires, the smart watch 100 can be automatically switched to the $1^{st}$ mode from the $2^{nd}$ mode. Moreover, before the expiration of the predetermined time, the smart watch 100 may be forced to be switched to the $1^{st}$ mode from the $2^{nd}$ mode by the aforementioned manual manipulation such as a hand's motion, a trigger manipulation, or the like. Meanwhile, for such a switching, like the searching step S30, the smart watch 100 can continue to search or monitor the aforementioned event or the aforementioned time expiration in the course of the step S30 of executing the $2^{nd}$ mode.

Figure 17:
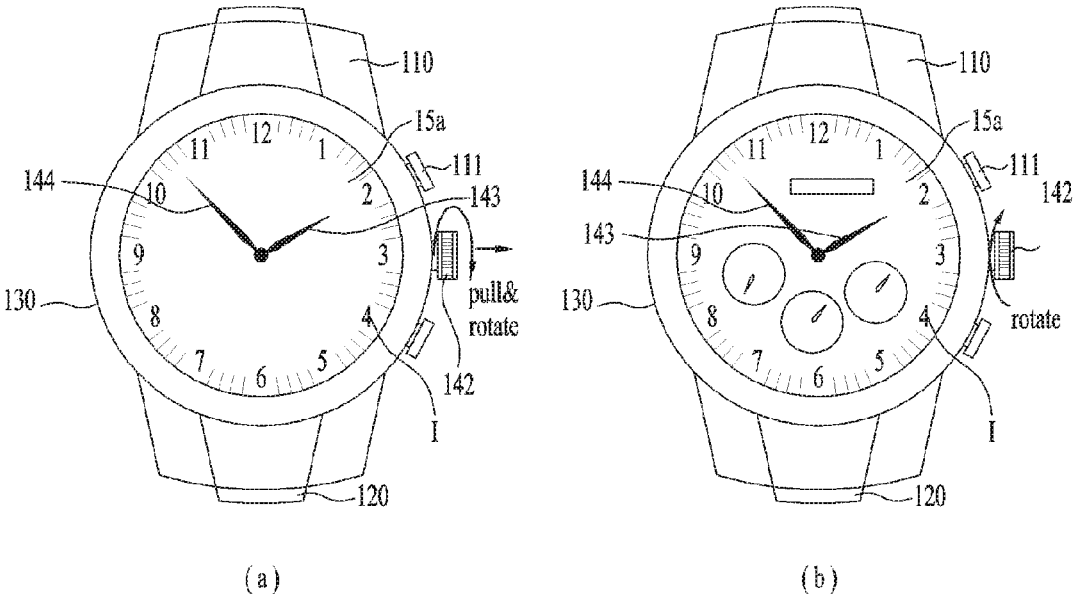
FIG. 17 is a schematic diagram to illustrate examples of controlling a smart watch in $1^{st}$ mode using a crown.

Meanwhile, in order to appropriately perform the functions intended in the $1^{st}$ mode executing step S10 and the $2^{nd}$ mode executing step S30, it is necessary to additionally control operations of various parts including the hands 143 and 144 and the display unit 15*a*. As mentioned in the foregoing description, such a control can be achieved by manipulating the input units or the input interface provided to the smart watch 100. Regarding such a manipulation, FIG. 17 is a schematic diagram to illustrate examples of controlling a smart watch in $1^{st}$ mode using a crown, FIG. 18 is a schematic diagram to illustrate examples of controlling a smart watch in $2^{nd}$ mode using a crown, and FIG. 19 is a schematic diagram to illustrate examples of controlling a smart watch in $1^{st}/2^{nd}$ mode using a touch sensor.

In the $1^{st}$ mode, the $2^{nd}$ mode, the $1^{st}$ mode executing step S10, and the $2^{nd}$ mode executing step S30, the crown 142 selected from various available input units can be used for a control of the smart watch 100. In particular, the display unit 15*a* and the hands 143 and 144 can be controlled by the crown 142 rotatably provided to the case 110. As mentioned in the foregoing description, since the crown 142 is connected to the controller 18 through the wiring 13*d*, the controller 18 can control the operations of the display unit 15*a* and the hands 143 and 144 based on the manipulation of the crown 142. For instance, as shown in FIG. 17 (*a*), if a watch function is provided in the $1^{st}$ mode, the crown 142 can be used to adjust the hands 143 and 144 in order to display an accurate time. In particular, if the crown 142 is pulled in the $1^{st}$ mode, the hands 143 and 144 are ready to move. If the crown 142 is rotated, the hands 143 and 144 can be rotated to display an accurate time. Moreover, referring to FIG. 17 (*b*), in the $1^{st}$ mode, the crown 142 can be used to change a background provided by the display unit 15*a*. In particular, in the $1^{st}$ mode, if the crown 142 is directly rotated without being pulled, additional function can be sequentially provided while backgrounds are changed. Namely, according to the rotation of the crown 142, screens for functions such as chronograph, calendar and the like can be displayed on the display unit 15*a*.

Figure 18:
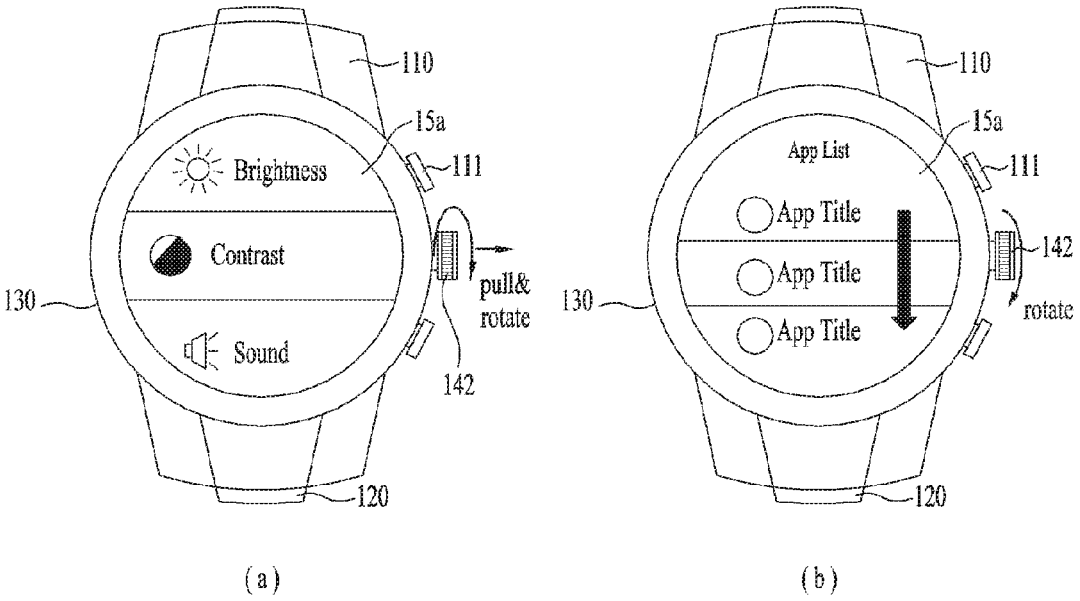
FIG. 18 is a schematic diagram to illustrate examples of controlling a smart watch in $2^{nd}$ mode using a crown.
Figure 19:
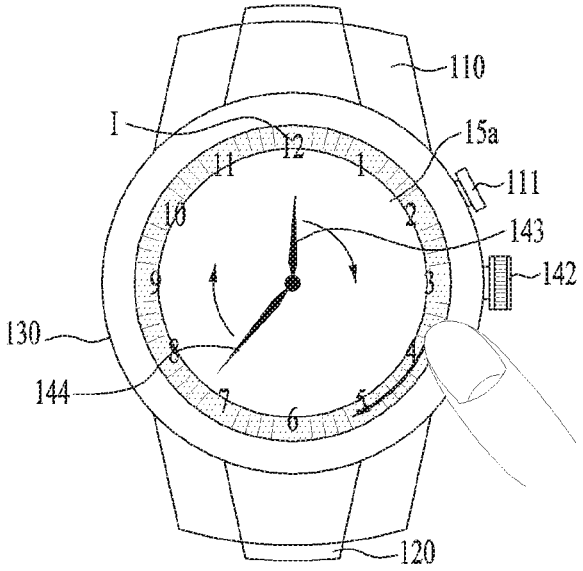
FIG. 19 is a schematic diagram to illustrate examples of controlling a smart watch in $1^{st}/2^{nd}$ mode using a touch sensor.

Furthermore, for example, as shown in FIG. 18 (*a*), in the $2^{nd}$ mode, the crown 142 can be used to change a setting of a specific function using a screen provided by the display unit 15*a*. In particular, if the crown 142 is pulled in the $2^{nd}$ mode, a currently run specific function is stopped and the smart watch (or device) 100 can enter a mode for changing its setting. Moreover, it is able to select a desired setting using a touch sensor, a different input unit, or an interface. Thereafter, by rotating the crown 142, a corresponding setting can be changed into a desired value. Moreover, referring to FIG. 18 (*b*), in the 2nd mode, the crown 142 can be used to scroll a prescribed list provided by the display unit 15*a*. In particular, when an application list is displayed in the $2^{nd}$ mode, if the crown 142 is directly rotated, a list is scrolled to display unseen applications.

On the other hand, in the $1^{st}$ mode, the $2^{nd}$ mode, the $1^{st}$ mode executing step S10, and the $2^{nd}$ mode executing step S30, a touch sensor selected from various available input units can be used for a control of the smart watch 100. In particular, the display unit 15*a* and the hands 143 and 144 can be controlled by the touch sensor provided to the window 15*e*. As mentioned in the foregoing description, since the touch sensor is connected to the controller 18 through the wiring 13*b*, the controller 18 can control the operations of the display unit 15*a* and the hands 143 and 144 based on the manipulation of the touch sensor. As mentioned in the foregoing description, by manipulating the touch sensor, i.e., by various finger touch motions applied to the touch sensor, various interfaces and objects in a screen displayed on the display unit 15*a* can be manipulated. Moreover, referring to FIG. 19, the physical hands 143 and 144 can be controlled by a touch motion applied to the touch sensor. For instance, by swiping the window 15*e* (i.e., touch sensor included therein), the hands 143 and 144 can be rotated. In particular, as shown in the drawing, if an edge of the window 15*e*, i.e., a rim portion adjacent to the bezel 130 is swiped in a specific direction, the hands 143 and 144 can be rotated in the same direction. Moreover, if a portion of the window 15*e* disposed above one of the hands 143 and 144 is touched before the rotation by the swipe, the corresponding hand can be selected. Thereafter, as mentioned in the foregoing description, if a user swipes the window 15*e* in a specific direction, the selected hand can be rotated in the same direction only. Such a preliminary selection, each of the hands 143 and 144 can be individually controlled.

The controls using the crow 142 and the touch sensor are applicable to the executions of the $1^{st}$ and $2^{nd}$ modes described with reference to FIG. 11 and FIGS. 14 to 16, whereby the $1^{st}$ and $2^{nd}$ modes can perform intended functions.

Accordingly, the smart watch and method for controlling the same disclosed in the present application have the following effects or features.

First of all, in the present application, a smart watch can structurally include both a physical analog watch and a smart device. In order to provide a user with the analog watch and the smart device as independent devices, the smart watch can structurally optimize the analog watch and the smart device. In particular, the parts (i.e., physical hands and movement) of the analog watch and the part (i.e., display unit) of the smart device can be disposed optimally. Moreover, the physical hands can be connected to the movement to operate optimally by avoiding interference with the display unit. Therefore, the smart watch can effectively provide a user with both an analog watch function (i.e., a display of a current time) with the physical hands and a smart watch function implemented through the display unit.

Secondly, a method of controlling a smart watch can optimally control an analog watch and a smart device, and more particularly, physical hands and a display unit in consideration of the structural features of the physical hands and the display unit. Therefore, the controlling method enables a user to efficiently use both a function of a physical analog watch and a function of a smart device, thereby providing facilitation and convenience in using the smart watch.

It will be appreciated by those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A smart watch, comprising:

a case;

at least one physical hand disposed in the case and configured to indicate a current time;

a display configured to display information, wherein the display is disposed in the case and below the at least one physical hand;

a movement configured to rotate the at least one physical hand and connected to the at least one physical hand through the display in the case;

a window disposed above the at least one physical hand wherein a touch sensor is coupled to a surface of the window;

a crown operably coupled to the movement and configured to: mechanically control the at least one physical hand, and cause a control signal to be generated in response to manipulation of the crown; and a processor configured to:

receive the generated control signal in response to manipulation of the crown, and control an operation of the display in response to the received generated control signal; and control the at least one physical hand in response to a touch input to the touch sensor, wherein in response to a swiping touch to the window in a first direction, the at least one physical hand is rotated in a second direction that is the same as the first direction to select an object displayed on the display.

2. The smart watch of claim 1, wherein the at least one physical hand comprises a single hand simultaneously indicating an hour and minute or an hour hand and a minute hand configured to respectively indicate the hour and the minute.

3. The smart watch of claim 1, wherein the movement is configured to be electronically controlled.

4. The smart watch of claim 1, wherein the movement is configured to use a power source separate from a power source of the display.

5. The smart watch of claim 1, further comprising:

a first battery configured to supply a first power to the display; and a second battery configured to supply a second power to the movement.

6. The smart watch of claim 1, wherein the display is positioned between the at least one physical hand and the movement.

7. The smart watch of claim 1, wherein the at least one physical hand is disposed above the display and wherein the movement is disposed below the display.

8. The smart watch of claim 1, wherein the display includes an opening configured to enable a connecting part of the movement and the at least one physical hand to pass through.

9. The smart watch of claim 1, wherein:

the movement is configured to rotate the at least one physical hand and comprises a shaft passing through the display to connect to the at least one physical hand.

10. The smart watch of claim 1, wherein:

the display is configured to entirely cover an opening formed in the case; and information is displayed on an entire surface of the display viewable through the opening.

11. The smart watch of claim 1, wherein the display is configured to operate according to:

a first display setting during a first mode for providing an analog watch function; or a second display setting during a second mode for providing functions different from the analog watch function, wherein the first display setting is different from the second display setting.

12. The smart watch of claim 11, wherein:

the first display setting comprises a watch face including an index indicated by the at least one physical hand to display a time; and the second display setting comprises a screen configured for providing the functions.

13. The smart watch of claim 1, wherein the display is configured to operate according to:

a first hand setting during a first mode for providing an analog watch function; or a second hand setting during a second mode for providing functions different from the analog watch function, wherein the first hand setting is different from the second hand setting.

14. The smart watch of claim 13, wherein the first hand setting includes different dispositions of the at least one physical hand and the second hand setting includes different transparencies of the at least one physical hand.

15. The smart watch of claim 13, wherein:

the first hand setting comprises disposing the at least one physical hand to indicate a current time based on indices displayed on the display; and the second hand setting comprises adjusting the at least one physical hand to maximize a viewable area of a screen of the display during the second mode.

16. The smart watch of claim 15, wherein the second hand setting further comprises aligning the at least one physical hand in a line or changing the at least one physical hand to be transparent.

17. The smart watch of claim 1, wherein:

the selected object displayed on the display is one of a plurality of displayed selectable options of a function executed at the smart watch;

each of the displayed selectable options is displayed at a corresponding selectable position along a rotation path of the at least one physical hand; and the processor is further configured to execute the function according to an option corresponding to the selected object.

* * * * *